US008014547B2

(12) United States Patent
Ogura et al.

(10) Patent No.: US 8,014,547 B2
(45) Date of Patent: Sep. 6, 2011

(54) PIEZOELECTRIC SPEAKER AND METHOD FOR MANUFACTURING THE SAME

(75) Inventors: Takashi Ogura, Kanagawa (JP); Kousaku Murata, Osaka (JP)

(73) Assignee: Panasonic Corporation, Osaka (JP)

( * ) Notice: Subject to any disclaimer, the term of this patent is extended or adjusted under 35 U.S.C. 154(b) by 1272 days.

(21) Appl. No.: 11/631,629

(22) PCT Filed: Dec. 16, 2005

(86) PCT No.: PCT/JP2005/023136

§ 371 (c)(1),
(2), (4) Date: Jan. 5, 2007

(87) PCT Pub. No.: WO2006/087866

PCT Pub. Date: Aug. 24, 2006

(65) Prior Publication Data

US 2008/0019544 A1 Jan. 24, 2008

(30) Foreign Application Priority Data

Feb. 17, 2005 (JP) ..... 2005-040144
May 25, 2005 (JP) ..... 2005-152267

(51) Int. Cl.
*H04R 25/00* (2006.01)

(52) U.S. Cl. ..... 381/190; 381/152; 381/398

(58) Field of Classification Search ..... 381/190–191, 381/152, 173–176, 399, 423–427, 431
See application file for complete search history.

(56) References Cited

U.S. PATENT DOCUMENTS

| | | | | |
|---|---|---|---|---|
| 4,421,381 | A | 12/1983 | Ueda et al. | |
| 6,278,790 | B1 * | 8/2001 | Davis et al. | 381/190 |
| 6,453,050 | B1 | 9/2002 | Ogura et al. | |
| 6,888,947 | B2 * | 5/2005 | Takeshima et al. | 381/190 |
| 6,978,032 | B2 | 12/2005 | Ogura et al. | |
| 2003/0099371 | A1 | 5/2003 | Ogura et al. | |
| 2004/0205949 | A1 | 10/2004 | Takeshima et al. | |

FOREIGN PATENT DOCUMENTS

| | | |
|---|---|---|
| CN | 1 257 399 | 6/2000 |
| CN | 1 422 102 | 6/2003 |
| GB | 2 040 642 | 8/1980 |
| JP | 53-076823 | 7/1978 |
| JP | 55-137199 | 9/1980 |

(Continued)

OTHER PUBLICATIONS

European Search Report issued Feb. 10, 2010 in connection with EP 05 81 6389.

*Primary Examiner* — Suhan Ni
(74) *Attorney, Agent, or Firm* — Wenderoth Lind & Ponack, L.L.P.

(57) ABSTRACT

A piezoelectric speaker comprises a plurality of diaphragms, connecting components, and piezoelectric elements. The plurality of diaphragms are each formed by a laminated material in which a core layer made of an insulating material is laminated to skin layers each made of a conductive material so as to form the skin layers on both surfaces of the core layer. The connecting components each corresponds to a plate-shaped component of the insulating material and connects between at least two of the plurality of diaphragms. Piezoelectric elements are mounted on surfaces of the plurality of diaphragms, respectively. The plurality of diaphragms are insulated from each other such that separate voltages are applied to the piezoelectric elements mounted thereon, respectively.

15 Claims, 24 Drawing Sheets

FOREIGN PATENT DOCUMENTS

| | | |
|---|---|---|
| JP | 56-17879 | 4/1981 |
| JP | 56-164928 | 12/1981 |
| JP | 57-101496 | 6/1982 |
| JP | 63-176099 | 7/1988 |
| JP | 63-257400 | 10/1988 |
| JP | 2001-016692 | 1/2001 |
| JP | 2003-230193 | 8/2003 |
| JP | 2004-180193 | 6/2004 |
| JP | 4035400 | 11/2007 |
| WO | 02/47433 | 6/2002 |

* cited by examiner

FIG. 10

| | f0(Hz) | AVERAGE SOUND PRESSURE (dB) |
|---|---|---|
| SPEAKER OF THE PRESENT INVENTION | 350 | 80 |
| SPEAKER SHOWN IN FIG. 8 | 480 | 75 |

PIEZOELECTRIC SPEAKER AND METHOD FOR MANUFACTURING THE SAME

BACKGROUND OF THE INVENTION

1. Technical Field

The present invention relates to a piezoelectric speaker for use in an acoustic device and the like, and a method for manufacturing the same.

2. Background Art

Conventionally, a piezoelectric speaker, known as a compact and low-current driven acoustic device in which a piezoelectric material is used as an electro-acoustic transducer element, is used as an acoustic output device for use in a compact device (for example, see Patent Document 1). In general, the piezoelectric speaker has a structure in which a piezoelectric element having formed thereon an electrode of silver thin film or the like is adhered to a metal diaphragm. A sound output mechanism of the piezoelectric speaker is such that an application of an AC voltage to both surfaces of the piezoelectric element causes a generation of a shape distortion of the piezoelectric element, so that the metal diaphragm is vibrated, thereby generating a sound.

On the other hand, a low-frequency reproduction capability of a speaker unit greatly depends on a volume of air to be released using an amplitude of vibration of the diaphragm included in the speaker unit. Therefore, in order to increase a reproduction bandwidth at a low-frequency side in the speaker unit, the speaker unit has to be constructed so as to increase an area of the diaphragm or increase a stroke of the diaphragm. However, when the speaker unit is mounted on a compact device or the like, the speaker unit is required to have a restricted diameter and thickness depending on a volumetric capacity of a casing of the device and other devices to be mounted thereon.

In recent years, while a market trend requires reductions in thickness, size, and weight of a mobile device such as a mobile telephone, an acoustic system mounted thereon is required to perform both high quality sound reproduction and stereo reproduction, resulting in the required number of speaker units being plural for realizing such reproductions. However, it is difficult to increase the sizes of the casing and the speaker against the trend or to leave the size of the device having a plurality of speaker units mounted thereon unchanged from a current size. Under such circumstances, although the high quality sound reproduction is expected, the compact device has mounted thereon an electrodynamic small-diameter micro speaker which provides a poor low-frequency reproduction performance.

Patent Document 1: Japanese Laid-Open Patent Publication No. 2001-16692

Here, as one of indexes used for determining a capability represented as an acoustic characteristic of a speaker unit, a lowest resonant frequency (hereinafter, referred to as an F0) is used. The lowest resonant frequency F0 is obtained using equation (1) as follows.

$$P=(2\pi f)^2\times\rho_0 a^2/2\pi l \quad (1)$$

where P: sound pressure (N/m$^2$), a$^2$: effective vibration area (m$^2$), $\rho_0$: air density, f: frequency (Hz), x: amplitude (m), l: measured distance (m).

According to equation (1), when a speaker (for example, a piezoelectric speaker) having a flat plate diaphragm performs a sound reproduction, the sound pressure P is proportional to the square of the frequency f. Therefore, in order to obtain a constant sound pressure throughout all bands, the lower the reproduction frequency is, the larger the vibration area a$^2$ and the amplitude x have to be, such that a volumetric capacity from which air is released by the diaphragm is increased.

Focusing on a portabililty, a mobile device such as a mobile telephone or a PDA (personal digital assistant) has such a favorable casing as to allow reductions in thickness, size, and weight of the device. Therefore, the speaker unit is often mounted in a restricted mounting space in a casing of the mobile device. Further, in a case where although the speaker unit is designed for stereo reproduction, the aforementioned space in which the speaker unit is mounted remains unchanged, the width, height, and depth thereof are restricted. When two speakers are mounted on the same plane, each of the speakers has its diameter halved. For example, when each of the speakers has a round shape, the vibration diameter area thereof is reduced to a quarter, thereby exerting a substantial influence on the low frequency reproduction.

Further, in general, since a user is allowed to rotate a display screen mounted on the mobile telephone or the PDA, the user can view a moving picture on the display screen oriented in two directions, i.e., oriented vertically and horizontally. That is, in order to maintain a stereo sound field at sound reproduction regardless of whether the display screen is oriented vertically or oriented horizontally, it is necessary to mount at least three (preferably at least four) speakers. However, since the speaker unit is to be mounted in a restricted space as described above, it is difficult to realize a stereo performance using a diameter of a speaker providing a mono performance as well as to increase the size of the speaker, taking into consideration places into which a plurality of speakers are mounted. That is, although the compact mobile device has to include a unit having a thickness and a diaphragm diameter increased so as to perform the low-frequency reproduction, it is difficult to provide a space for mounting the plurality of speakers capable of performing the stereo reproduction and the like because of a reduced volumetric capacity for mounting the speaker units.

Therefore, an object of the present invention is to provide a piezoelectric speaker, which is mounted in a reduced volumetric capacity, capable of performing both a low-frequency reproduction and a stereo reproduction, and a method for manufacturing the same.

SUMMARY OF THE INVENTION

In order to attain the aforementioned object, the present invention has the following features.

A first aspect is directed to a piezoelectric speaker comprising a plurality of diaphragms, connecting components, and piezoelectric elements. The plurality of diaphragms are each formed by a laminated material in which a core layer made of an insulating material is laminated to skin layers each made of a conductive material so as to form the skin layers on both surfaces of the core layer. The connecting components each corresponds to a plate-shaped component of an insulating material and each connects between at least two of the plurality of diaphragms. The piezoelectric elements are mounted on surfaces of the plurality of diaphragms, respectively. The plurality of diaphragms are insulated from each other such that separate voltages are applied to the piezoelectric elements mounted thereon, respectively.

In a second aspect based on the first aspect, the piezoelectric speaker further comprises a frame, first dampers and second dampers. The first dampers and the second dampers connect between the frame and the plurality of diaphragms, and support the plurality of diaphragms such that the plurality of diaphragms are capable of linearly vibrating. The plurality of diaphragms have insulating slits, respectively, each of which is formed between an area connected to the first dampers and an area connected to the second dampers by removing a portion of each of the skin layers, such that the first dampers are insulated from the second dampers on the plurality of diaphragms.

In a third aspect based on the second aspect, the plurality of diaphragms, the first dampers and the second dampers connecting between the frame and the plurality of diaphragms, and the connecting components are disposed in the frame. The plurality of diaphragms, the insulating slits, the first dampers, the second dampers, the connecting components, and the frame are integrally formed by processing each of the skin layers of the laminated material.

In a fourth aspect based on the third aspect, the plurality of diaphragms, the insulating slits, the first dampers, the second dampers, the connecting components, and the frame are formed on both surfaces of the laminated material by etching the skin layers of the laminated material on said both surfaces of the laminated material, using a predetermined pattern, at corresponding positions on a front side and a back side of the laminated material.

In a fifth aspect based on the first aspect, the connecting components are each formed by the core layer of the laminated material.

In a sixth aspect based on the second aspect, electrodes are formed on both surfaces of each of the piezoelectric elements. One of the electrodes is formed on a surface of each of the piezoelectric elements on which said each of the piezoelectric elements is mounted on one of the plurality of diaphragms, and contacts with the one of the plurality of diaphragms only in the area connected to the first dampers separated by the insulating slits.

In a seventh aspect based on the second aspect, the connecting components each connects between two of the plurality of diaphragms in a space therebetween, the two of the plurality of diaphragms corresponding to one of first diaphragms and one of second diaphragms which are disposed in line with each other. The connecting components, the first diaphragms, the second diaphragms, the first dampers and the second dampers connecting the first diaphragms and the second diaphragms to the frame are disposed in the frame.

In an eighth aspect based on the seventh aspect, removal slits are provided, and each of the removal slits is formed between one of the first diaphragms and one of the second diaphragms by removing each of the skin layers in a direction perpendicular to a direction in which the one of the first diaphragms and the one of the second diaphragms are disposed in line with each other such that each of the removal slits allows two separated diaphragms to be formed.

In a ninth aspect based on the eighth aspect, the piezoelectric speaker further comprises signal input means. The signal input means inputs an input signal of a left channel to the piezoelectric elements mounted on the first diaphragms and inputs an input signal of a right channel to the piezoelectric elements mounted on the second diaphragms when the piezoelectric speaker is oriented in a first direction in which each of the first diaphragms and each of the second diaphragms are disposed sideways in line with each other. The signal input means inputs an input signal of the right channel to the piezoelectric elements mounted on one of the first diaphragms and one of the second diaphragms which are separated by a corresponding one of the removal slits, and inputs an input signal of the left channel to the piezoelectric elements mounted on an other of the first diaphragms and an other of the second diaphragms which are separated by a corresponding one of the removal slits when the piezoelectric speaker is oriented in a second direction in which each of the first diaphragms and each of the second diaphragms are disposed longways in line with each other.

In a tenth aspect based on the first aspect, the conductive material of the skin layers is a metal thin film material containing at least one selected from the group consisting of a 42 alloy, a stainless steel, a copper, an aluminum, a titanium, and a silver paste. The insulating material of the core layer is at least one selected from the group consisting of a polyimide and polyimide metamorphic body.

In an eleventh aspect based on the first aspect, the conductive material of the skin layers is a metal thin film material containing at least one selected from the group consisting of a 42 alloy, a stainless steel, a copper, an aluminum, a titanium, and a silver paste. The insulating material of the core layer is a rubber high polymer containing at least one selected from the group consisting of an SBR, an NBR, and an acrylonitrile.

In a twelfth aspect based on the first aspect, the conductive material of the skin layers is a metal thin film material containing at least one selected from the group consisting of a 42 alloy, a stainless steel, a copper, an aluminum, a titanium, and a silver paste. The insulating material of the core layer is a plastic material containing at least one selected from the group consisting of polyethylene terephthalate, polycarbonate, and polyallylate film.

In a thirteenth aspect based on the first aspect, the piezoelectric speaker further comprises an external diaphragm. The external diaphragm, connecting to the plurality of diaphragms, is formed by a film component of an insulating material and provided in an outer periphery area of the plurality of diaphragms.

In a fourteenth aspect based on the thirteenth aspect, the external diaphragm and the plurality of diaphragms are integrally formed by extending the core layer of the laminated material of the plurality of diaphragms.

In a fifteenth aspect based on the second aspect, the piezoelectric speaker further comprises an external diaphragm. The external diaphragm, connecting to the frame, is formed by a film component of an insulating material and provided in an outer periphery area of the frame.

In a sixteenth aspect based on the fifteenth aspect, the external diaphragm and the plurality of diaphragms are integrally formed by extending the core layer of the laminated material of the plurality of diaphragms.

A seventeenth aspect is directed to a method for manufacturing a piezoelectric speaker comprising: a step of forming a laminated material by laminating a core layer made of an insulating material to skin layers each made of a conductive material so as to form the skin layers on both surfaces of the core layer; a step of forming a plurality of diaphragms insulated from each other by etching the skin layers of the laminated material on both surfaces of the laminated material, using a predetermined pattern, at corresponding positions on a front side and a back side of the laminated material; a step of connecting between at least two of the plurality of diaphragms by using connecting components, each having a plate shape, of an insulating material; and a step of mounting piezoelectric elements on surfaces of the plurality of diaphragms, respectively.

In an eighteenth aspect based on the seventeenth aspect, a step of forming an external diaphragm through bonding is further provided. In the step of forming an external diaphragm through bonding, an external diaphragm is formed by bonding two film components to each other in an outer periphery area of the plurality of diaphragms connected to each other by the connecting components, and bonding the external diaphragm to the plurality of diaphragms by sandwiching an edge portion of the plurality of diaphragms, from both surfaces thereof, between portion of the two film components.

In a nineteenth aspect based on the seventeenth aspect, the step of forming the plurality of diaphragms includes a step of forming, by etching the skin layers, a frame, and first dampers and second dampers which connect between the frame and the plurality of diaphragms and support the plurality of diaphragms such that the plurality of diaphragms are capable of linearly vibrating. The method for manufacturing the piezoelectric speaker further comprises a step of forming an external diaphragm through bonding. In the step of forming an external diaphragm through bonding, an external diaphragm is formed by bonding two film components to each other in an outer periphery area of the frame, and bonding the external diaphragm to the frame by sandwiching, between portions of the two film components, edge portions of the skin layers of the frame on one surface of one of the skin layers and one surface of an other of the skin layers or an edge portion of the core layer of the frame from both surfaces thereof.

A twentieth aspect is directed to a method for manufacturing a piezoelectric speaker, comprising: a step of forming a core layer of an insulating material; a step of forming a laminated material by printing skin layers of a conductive material on both surfaces of the core layer, using a predetermined pattern, at corresponding positions on a front side and a back side of the laminated material so as to form a plurality of diaphragms insulated from each other; a step of forming, as one of connecting components, an area which is formed by only the core layer provided between at least two of the plurality of diaphragms by removing another predetermined area formed by only the core layer; and a step of mounting piezoelectric elements on surfaces of the plurality of diaphragms, respectively.

According to the first aspect, the connecting components connected to at least two diaphragms are displaced in phase with the at least two diaphragms at low-frequency reproduction, and therefore the connecting components each functions as a diaphragm. Thus, the piezoelectric speaker, having a preferable sound pressure characteristic at low-frequencies, capable of performing stereo reproduction can be mounted in a space of a reduced mounting volumetric capacity.

According to the second aspect, separate voltages can be applied to both poles of each of the piezoelectric elements mounted on the diaphragms through the first dampers and the second dampers.

According to the third aspect, the skin layers of one piece of laminated material are processed so as to form the respective components of the piezoelectric speaker, thereby simplifying the manufacture thereof.

According to the fourth aspect, the skin layers are etched and removed at corresponding positions on the front side and the back side so as to form the insulating slits and the connecting components, thereby simplifying the manufacture thereof.

According to the fifth aspect, the connecting components are formed by the same core layer as used for other components, thereby simplifying the manufacture thereof.

According to the sixth aspect, only a voltage applied from the first dampers can be applied to the adhering surface of each of the piezoelectric elements mounted on the diaphragms.

According to the seventh aspect, the two diaphragms supported by the dampers so as to be within the frame enable the stereo reproduction.

According to the eighth aspect, the four diaphragms supported by the dampers so as to be within the frame enable the stereo reproduction.

According to the ninth aspect, a mechanical or an electronic switching of the input signal enables one unit to realize the stereo reproduction regardless of whether the piezoelectric speaker is oriented vertically or horizontally, thereby enabling stereo reproduction causing no acoustic discomfort.

According to the tenth through twelfth aspects, an option of selecting a material of the piezoelectric speaker can be broadened, thereby allowing various designs and manufactures in accordance with sound reproduction condition.

According to the thirteenth or fifteenth aspect, since the external diaphragm is further provided on the outer periphery, the diaphragm to be mounted can have an area obtained by effectively utilizing an unused space in the casing, which is advantageous to low-frequency reproduction. Further, the reproduction performed by using the diaphragm of a broader width allows enhanced stereo performance. Moreover, the external diaphragm formed by a film component such as a resin, or the like, is flexible, so that the external diaphragm can be partially curved and then mounted, whereby it is possible to mount the external diaphragm in a narrow space.

According to the fourteenth or the sixteenth aspect, the external diaphragm is formed by the same core layer as used for other components, thereby simplifying the manufacture thereof.

Furthermore, in a method for manufacturing the piezoelectric speaker according to the present invention, a piezoelectric speaker having the same effects as described above can be manufactured.

BRIEF DESCRIPTION OF THE DRAWINGS

FIG. 10 is a diagram illustrating a result of measuring lowest resonant frequencies f0 and the average sound pressures of the piezoelectric speaker shown in FIG. 3 and the piezoelectric speaker shown in FIG. 8.

DESCRIPTION OF THE REFERENCE CHARACTERS

Figure 1:
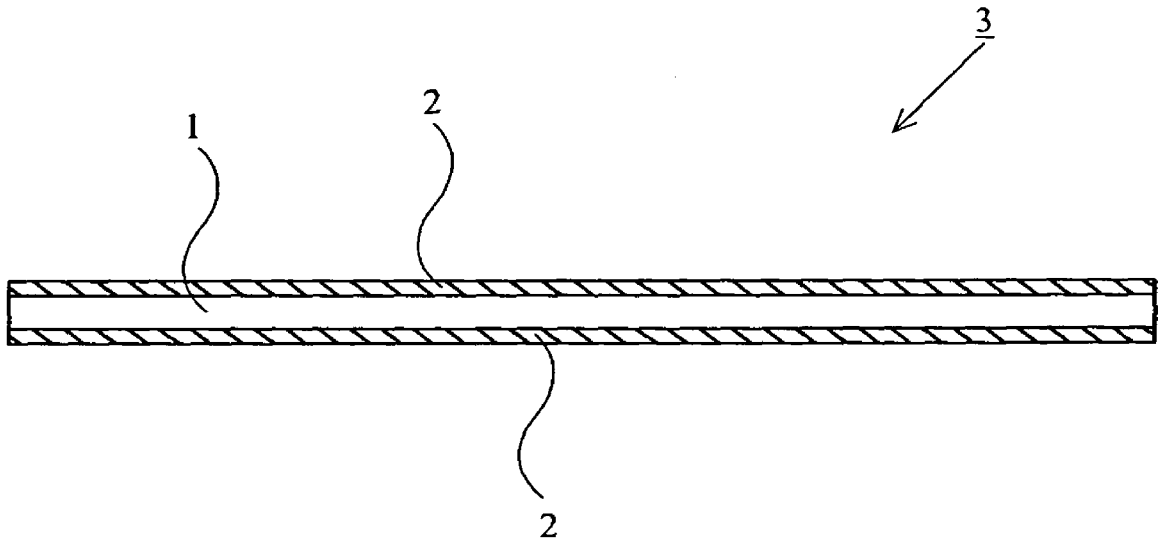
FIG. 1 is a diagram illustrating a cross-sectional structure of a speaker diaphragm for use in a piezoelectric speaker according to embodiments of the present invention.

1 core layer
2 skin layers
3 laminated material
4, 24 diaphragm
5, 25 piezoelectric element
6, 26 removed portion
7, 27 insulating slit
8, 28 frame
9, 29 damper
10, 30 edge
11, 21 conductive paste
12, 32 silver electrode
14, 34 indentation
35 insulating portion
40 rotation axis
41 wiring
42 terminal
50 stationary terminal
60 external frame
61 external diaphragm
62 wiring section

DETAILED DESCRIPTION OF THE INVENTION

First Embodiment

Hereinafter, a piezoelectric speaker according to a first embodiment of the present invention will be described with reference to the drawings. FIG. 1 is a diagram illustrating a cross-sectional structure of a speaker diaphragm for use in the piezoelectric speaker.

The diaphragm according to the present embodiment has a laminated material 3. The laminated material 3, including a core layer 1 and skin layers 2, is laminated such that the core layer 1 corresponding to an intermediate layer is sandwiched from both surfaces thereof between the skin layers 2. The core layer 1 is made of insulating material. The skin layers 2 are made of conductive material.

For example, while the insulating material of the core layer 1 is polyimide, the insulating material thereof may be polyimide metamorphic body. Further, the insulating material of the core layer 1 may be material having insulating properties such as rubber high polymer material (SBR, NBR, acrylonitrile and the like), liquid crystal polymer, and general-purpose plastic material (polyethylene terephthalate, polycarbonate, polyallylate film, and the like).

On the other hand, while the conductive material of the skin layers 2 is 42 alloy, stainless steel may be used instead thereof. Further, as the conductive material of the skin layers 2, thin film material containing any of metals such as copper, aluminum, titanium, and silver (silver paste), or thin film material of an alloy thereof may be used. Moreover, as the conductive material of the skin layers 2, conductive thin film material having applied and hardened thereon paste material containing metal component may be used. Furthermore, an adhesive can be applied between both layers, i.e., the core layer 1 and each of the skin layers 2.

In the following description, for example, each of the skin layers 2 has a thickness of 25 μm (micrometer) (since two layers are provided on both sides of the core layer 1 in an example shown in FIG. 1, the total thickness thereof is 50 μm), and the core layer 1 has a thickness of 50 μm, resulting in the total thickness of the laminated material 3 being 100 μm. The thickness of the laminated material 3 of the diaphragm exerts an influence on acoustic characteristics, and therefore the total thickness is typically set to about 50 to 150 μm. However, for example, when the diaphragm is used only in a specific frequency range, or when stiffness is partially added thereto so as to improve the acoustic characteristics, the thickness of each of the layers or the total thickness can be increased or reduced. Further, the layer may additionally include other components when an electrical wiring is installed in the material of the diaphragm or a vibration is controlled.

Figure 2:
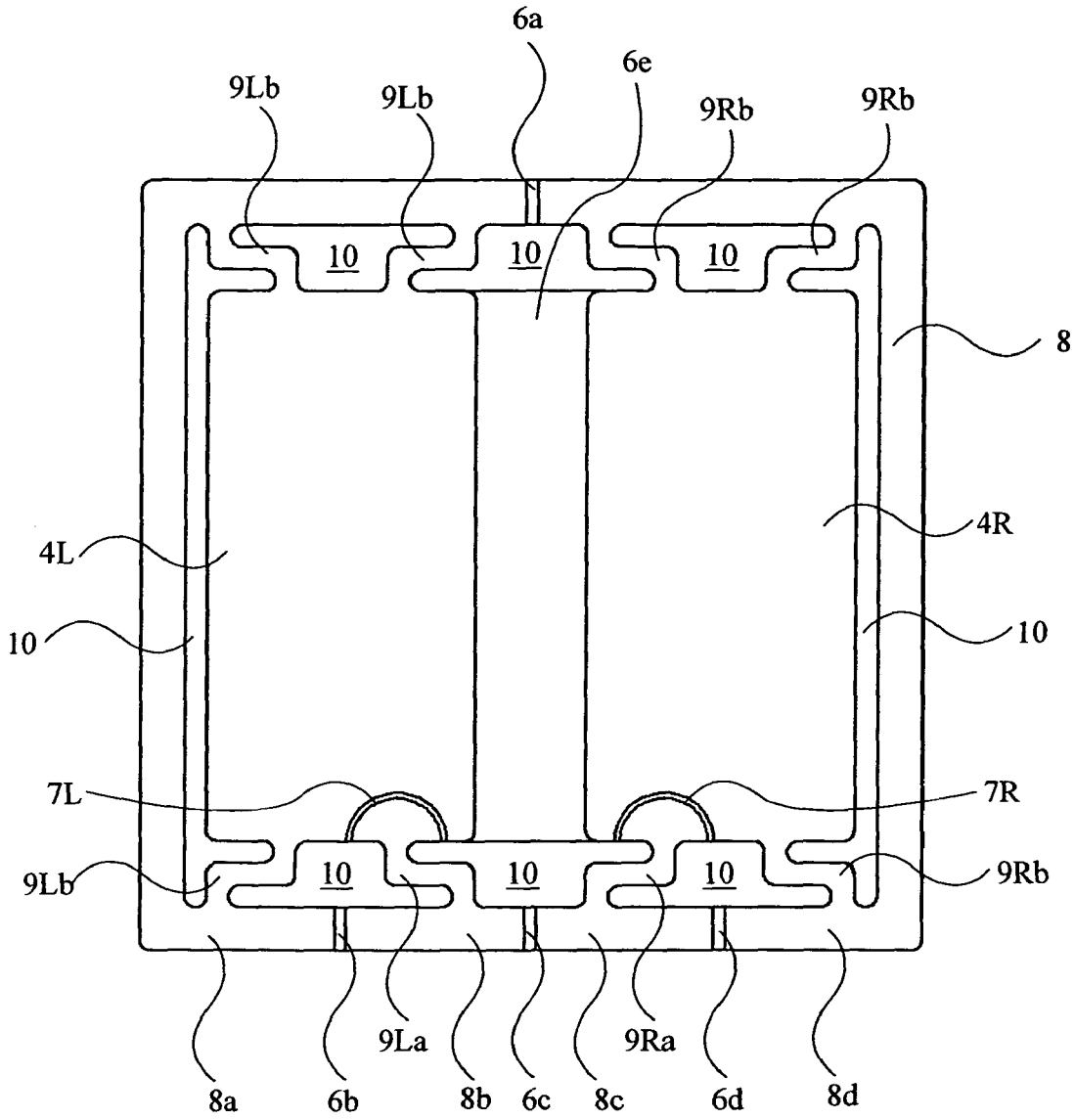
FIG. 2 is a diagram illustrating a front surface of the piezoelectric speaker which does not have a piezoelectric element 5 mounted thereon according to a first embodiment of the present invention.
Figure 3:
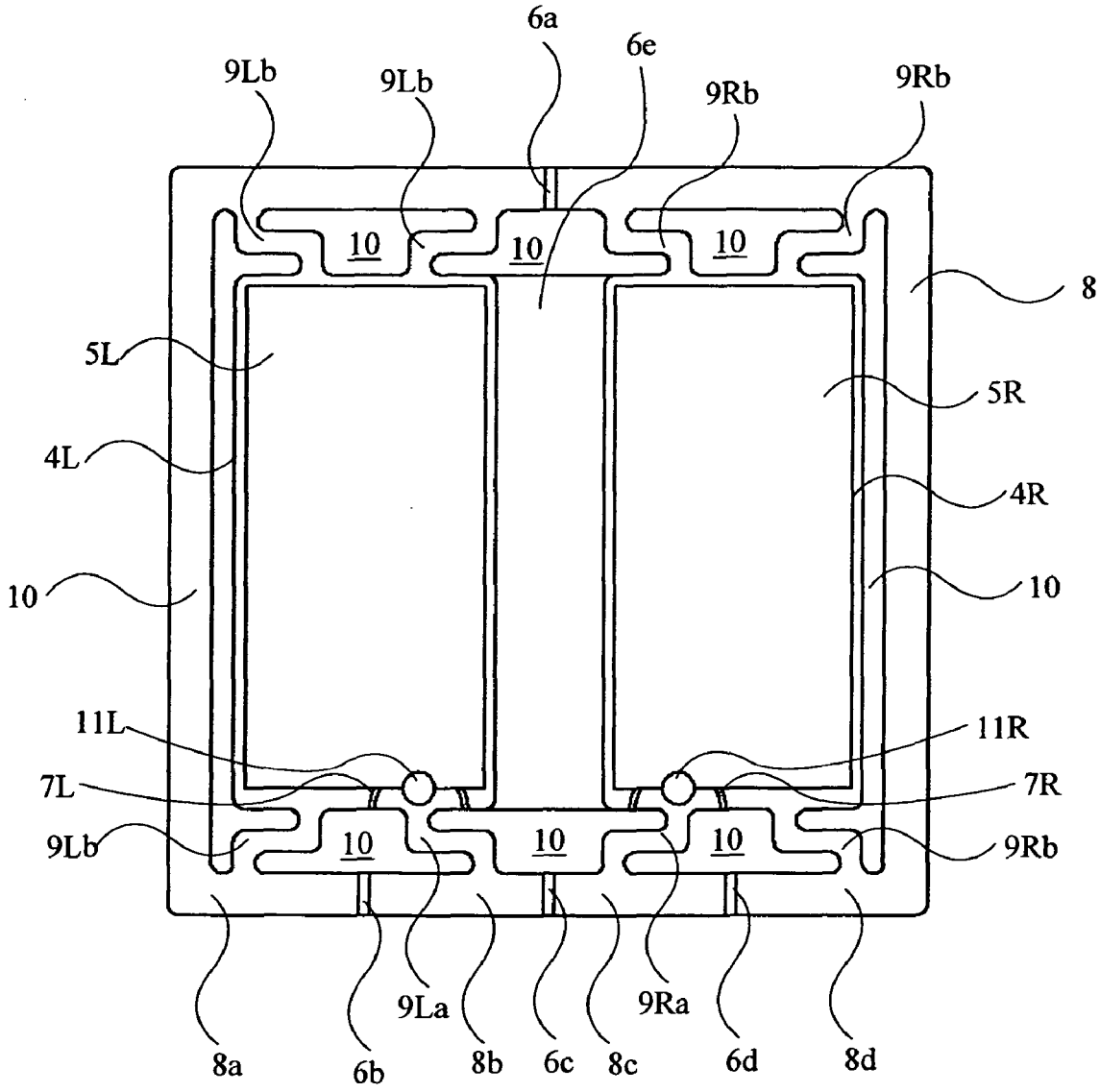
FIG. 3 is a diagram illustrating the front surface of the piezoelectric speaker, shown in FIG. 2, which has the piezoelectric element 5 mounted thereon.

FIG. 2 and FIG. 3 are diagrams each illustrating components of the piezoelectric speaker according to the first embodiment of the present invention. FIG. 2 is a diagram illustrating a front surface of the piezoelectric speaker which does not have a piezoelectric element 5 mounted thereon. FIG. 3 is a diagram illustrating the front surface of the piezoelectric speaker which has the piezoelectric element 5 mounted thereon. The front side and the back side of the piezoelectric speaker has the same structure, and therefore the structure of the front side (front surface) will be mainly described.

In FIG. 2 and FIG. 3, the piezoelectric speaker has a plurality (two in the present embodiment) of diaphragms 4L and 4R on the same plane surface. The diaphragm 4L is supported by a frame 8 through a damper 9La and three dampers 9Lb. The diaphragm 4R is supported by the same frame 8 through a damper 9Ra and three dampers 9Rb. Further, piezoelectric elements 5L and 5R are mounted on main surfaces of the diaphragms 4L and 4R, respectively. A conductive paste 11L straddles a portion of the top surface of the piezoelectric element 5L and a portion of the main surface on which the diaphragm 4L is mounted, and a conductive paste 11R straddles a portion of the top surface of the piezoelectric element 5R and a portion of the main surface on which the diaphragm 4R is mounted.

The diaphragms 4L and 4R are supported by the frame 8 through the dampers 9La and 9Lb, and the dampers 9Ra and 9Rb, respectively, such that the diaphragms 4L and 4R can linearly vibrate. Here, that the diaphragms 4L and 4R can linearly vibrate means that, in a state where the surfaces of the diaphragms 4L and 4R are substantially parallel to a reference surface (for example, a surface parallel to the frame 8 supporting the diaphragms 4L and 4R at a position at which the diaphragms 4L and 4R are at rest), the diaphragms 4L and 4R vibrate in a direction substantially perpendicular to the reference surface (or the diaphragms 4L and 4R can be deemed to vibrate in a direction substantially perpendicular to the reference surface).

As shown in FIG. 2 and FIG. 3, each of the diaphragms 4L and 4R is almost rectangular. The diaphragm 4L is connected to the left half of the substantially rectangular frame 8 so as to be within the frame 8 through one damper 9La and three dampers 9Lb each of which is almost S-shaped and acts as an arm-shaped link. On the other hand, the diaphragm 4R is connected to the right half of the substantially rectangular frame 8 so as to be within the frame 8 through one damper 9Ra and three dampers 9Rb each of which is almost S-shaped and acts as an arm-shaped link. As is apparent from the following description, the core layer 1 (removed portion 6*e*) is formed between the diaphragms 4L and 4R. Hereinafter, the diaphragms 4L and 4R may be collectively referred to as a diaphragm 4. Further, the dampers 9La, 9Lb, 9Ra, and 9Rb may be collectively referred to as a damper 9.

The aforementioned laminated material 3 of a flat plate is subjected to, for example, etching process and/or pressing process so as to integrally form the diaphragm 4, the frame 8, and the damper 9. Initially, areas other than areas on which the diaphragm 4, the frame 8, and the damper 9 are to be formed are subjected to the etching process so as to remove the skin layers 2 from both surfaces of the laminated material 3, thereby forming, on both surfaces thereof, the respective skin layers 2 of only the areas on which the diaphragm 4, the frame 8, and the damper 9 are integrally formed. Through the etching process, the diaphragm 4, the frame 8, and the damper 9 are formed by partially laying the skin layers 2 on each of the surfaces of the core layer 1.

Further, edges 10 are formed as slits on the four sides of the diaphragms 4L and 4R between the frame 8 and the diaphragms 4L and 4R. Specifically, the edges 10 are each a slit area (excluding an area between the diaphragms 4L and 4R) on which the damper 9 is not formed, among clearance areas formed between the frame 8 and the diaphragm 4. The edges 10 are formed such that the areas corresponding to the slits are removed, through punching and the like, from the core layer 1 exposed through the etching process so as to form cavities, and the cavities are filled with resin of high polymer or the like having an appropriate flexibility. For example, the edges 10 are formed by applying, to the cavities of the laminated material 3 of the frame 8, the diaphragm 4, and the damper 9, solution of high polymer resin having flexibility (rubber elasticity) obtained through hardening. The hardened high polymer resin is retained in the cavities between the diaphragm 4 and the frame 8. For example, the edges 10 may be formed by filling the cavities with rubber high polymer elastomer, having flexibility and Young's modulus of about 1 to 10 MPa, such as rubber including SBR (styrene-butadiene rubber), SBS (styrene-butadiene-styrene rubber), silicone rubber, IIR (butyl rubber), EPM (ethylene propylene rubber), urethane rubber, or a metamorphic body of any of these rubbers. Further, when the core layer 1 is formed through the punching, a Thompson blade or a pinnacle die may be used, or organic solvent or acid-alkali solvent, which is capable of melting the core layer 1, may be used to remove a predetermined portion of the core layer 1. As a method for forming the edges 10, a method in which capillary phenomenon occurring due to surface tension of the liquid high polymer resin is utilized to retain the high polymer resin in the cavities may be used. Further, the cavities corresponding to the edges 10 may not be formed by punching the areas corresponding to the slits or the like, that is, the core layer 1 exposed through the etching process may be directly used as the edges 10.

Further, prior to the laminated material 3 being formed, metal plates of the skin layers 2 containing the conductive material may be punched such that areas on which the diaphragm 4, the frame 8, and the damper 9 are formed are left unpunched, and thereafter the skin layers 2 may be adhered to both surfaces of the core layer 1 of the insulating material, thereby forming the diaphragm 4, the frame 8, the damper 9, and the edges 10. In any method, the etching process and/or the punching process are used to integrally form the diaphragms 4L and 4R, the frame 8, the dampers 9La, 9Lb, 9Ra, and 9Rb, and the edges 10.

Here, as is apparent from FIG. 2 and FIG. 3, each of the dampers 9La, 9Lb, 9Ra, and 9Rb, which is formed by the skin layer 2, can also function as a portion of an electrode or of an electrical wiring. According to the present embodiment, in order to electrically insulate the dampers 9La, 9Lb, 9Ra, and 9Rb from each other, a portion of the skin layers 2 of the frame 8 and the diaphragms 4L and 4R is removed through the etching process or the like so as to form removed portions 6*a*, 6*b*, 6*c*, 6*d*, and 6*e*, and insulating slits 7L and 7R. That is, the removed portions 6*a*, 6*b*, 6*c*, 6*d*, and 6*e*, and the insulating slits 7L and 7R are areas in which the core layer 1 is exposed from the laminated material 3, and the areas are boundaries provided for ensuring electrical insulation. The aforementioned removal of the skin layers 2 may be performed simultaneously with the etching process through which the diaphragm 4, the frame 8, and damper 9 are formed.

As shown in FIG. 2 and FIG. 3, the four removed portions 6*a*, 6*b*, 6*c*, and 6*d* are formed on the frame 8 so as to separate the frame 8 into four frames 8*a*, 8*b*, 8*c*, and 8*d* which are insulated from each other. The four frames 8*a*, 8*b*, 8*c*, and 8*d*, which are electrically insulated and separated from each other, are areas which are physically connected to each other through the core layer 1. The frame 8*a*, formed between the removed portions 6*a* and 6*b*, is connected to the diaphragm 4L through the three dampers 9Lb. The frame 8*b*, formed between the removed portions 6*b* and 6*c*, is connected to the diaphragm 4L through one damper 9La. The frame 8*c*, formed between the removed portions 6*c* and 6*d*, is connected to the diaphragm 4R through one damper 9Ra. The frame 8*d*, formed between the removed portions 6*a* and 6*d*, is connected to the diaphragm 4R through the three dampers 9Rb. As an example shown in FIG. 2 and FIG. 3, the damper 9La and the damper 9Ra are disposed adjacent to each other.

Further, the removed portion 6*e* is formed between the diaphragms 4L and 4R. Here, while separate voltages are applied to the diaphragms 4L and 4R, respectively, a phase of the voltage applied to the diaphragm 4L is often approximate to or the same as a phase of the voltage applied to the diaphragm 4R at a low frequency reproduction. Accordingly, at the low frequency reproduction, the diaphragms 4L and 4R are displaced in phase with each other, and the removed portion 6*e* is also displaced in phase with the diaphragms 4L and 4R. Therefore, at the low frequency reproduction, the removed portion 6*e* functions as a diaphragm. On the other hand, at a high frequency reproduction, the voltages applied to the diaphragms 4L and 4R are not necessarily in phase with each other, and the removed portion 6*e* does not function as a diaphragm but functions as an edge, unlike at the low frequency reproduction. In an example shown in FIG. 2 and FIG. 3, two areas (area surrounded by the top edge of the removed portion 6*e*, the frame 8, and the dampers 9Lb and 9Rb, and area surrounded by the bottom edge of the removed portion 6*e*, the frame 8, and the dampers 9La and 9Ra) formed on the top and the bottom of the removed portion 6*e* are used as the edges 10. However, these areas may be also used as the removed portion 6*e*.

The insulating slit 7L is formed on the diaphragm 4L adjacent to an area connecting to the damper 9La, so as to separate the diaphragm 4L into two areas (hereinafter, referred to as an area 4La and an area 4Lb) which are insulated from each other. The insulating slit 7L separates the diaphragm 4L into the area 4Lb connected to the frame 8*a* through the three dampers 9Lb and the area 4La connected to the frame 8*b* through the damper 9La. Although the diaphragm 4L is separated into two areas 4La and 4Lb which are electrically insulated from each other by the insulating slit 7L, the two areas are physically connected to each other through the core layer 1. On the other hand, the insulating slit 7R is formed on the diaphragm 4R adjacent to an area connecting to the damper 9Ra, so as to separate the diaphragm 4R into two areas (hereinafter, referred to as an area 4Ra and an area 4Rb) which are insulated from each other. The insulating slit 7R separates the diaphragm 4R into the area 4Rb connected to the frame 8*d* through the three dampers 9Rb and the area 4Ra connected to the frame 8*c* through the damper 9Ra. Although the diaphragm 4R is separated into two areas 4Ra and 4Rb which are electrically insulated from each other by the insulating slit 7R, the two areas are physically connected to each other through the core layer 1.

The removed portions 6*a*, 6*b*, 6*c*, 6*d*, and 6*e*, and the insulating slits 7L and 7R are formed so as to insulate the dampers 9Lb and the frame 8*a* connected to the diaphragm 4L, the damper 9La and the frame 8*b* connected to the diaphragm 4L, the damper 9Ra and the frame 8*c* connected to the diaphragm 4R, and the dampers 9Rb and the frame 8*d* connected to the diaphragm 4R from each other, whereby it is possible to apply separate voltages thereto.

Figure 4:
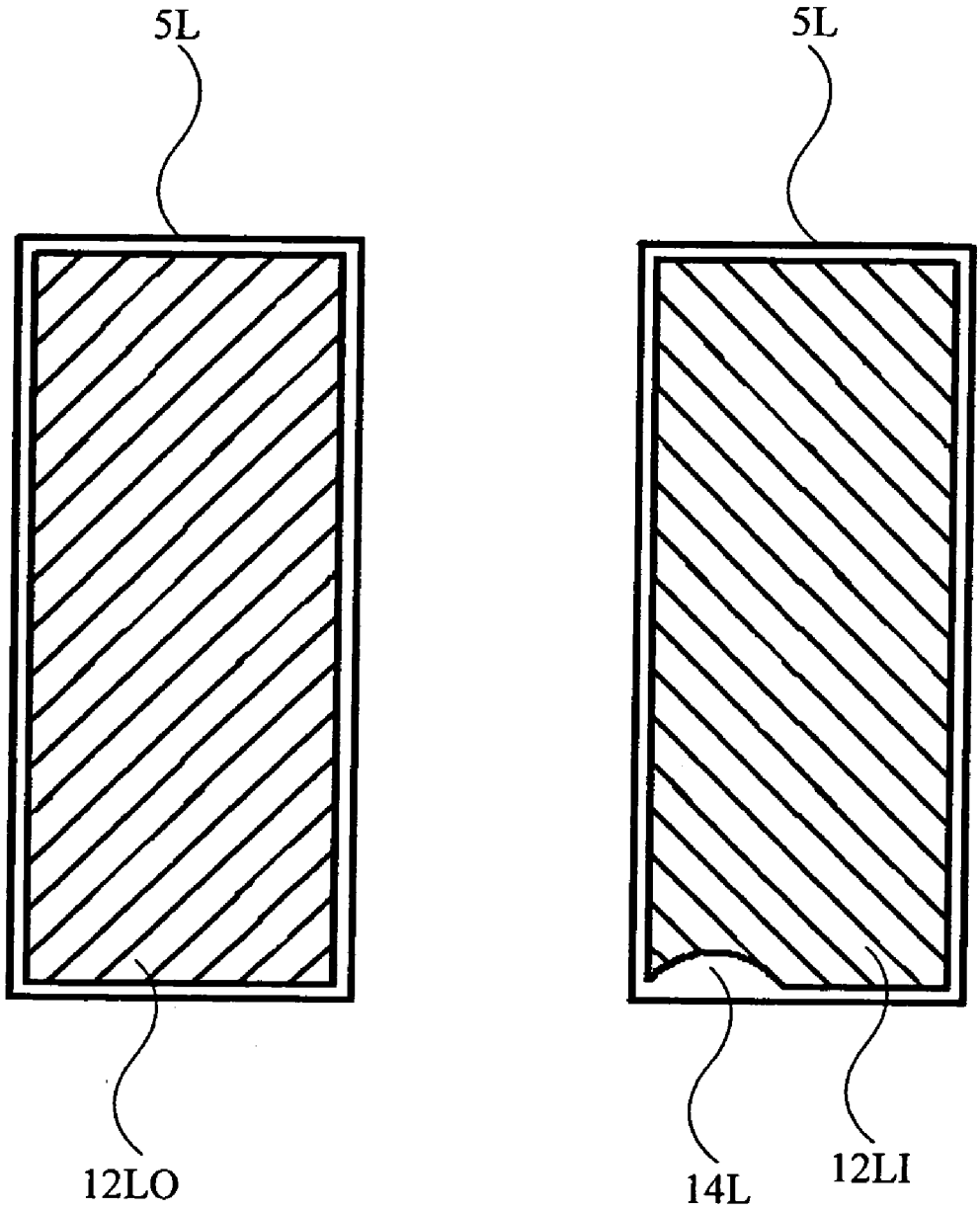
FIG. 4 shows specific structures of a front and a back surfaces of the piezoelectric element 5L mounted on the diaphragm 4L shown in FIG. 2.

FIG. 4 specifically shows an example of structures of the front and the back surfaces of the piezoelectric element 5L mounted on the diaphragm 4L. On the other hand, FIG. 5 specifically shows an example of structures of the front and the back surfaces of the piezoelectric element 5R mounted on the diaphragm 4R.

In FIG. 4, a silver electrode 12LO is provided on the front surface of the piezoelectric element 5L. On the other hand, a silver electrode 12LI is provided on the adhering surface of the piezoelectric element 5L excluding a portion of area (indentation 14L). The silver electrode 12LI provided on the piezoelectric element 5L is adhered to the diaphragm 4L using, for example, an acrylic adhesive such that the silver electrode 12LI contacts with the area 4Lb conductively connected to the frame 8*a* and the dampers 9Lb. At this time, since the indentation 14L on which the silver electrode 12LI is not provided is formed, the silver electrode 12LI does not contact with the area 4La of the diaphragm 4L. That is, even when the piezoelectric element 5L is mounted on the diaphragm 4L, the frame 8*b* and the damper 9La are electrically insulated from the silver electrode 12LI.

Figure 5:
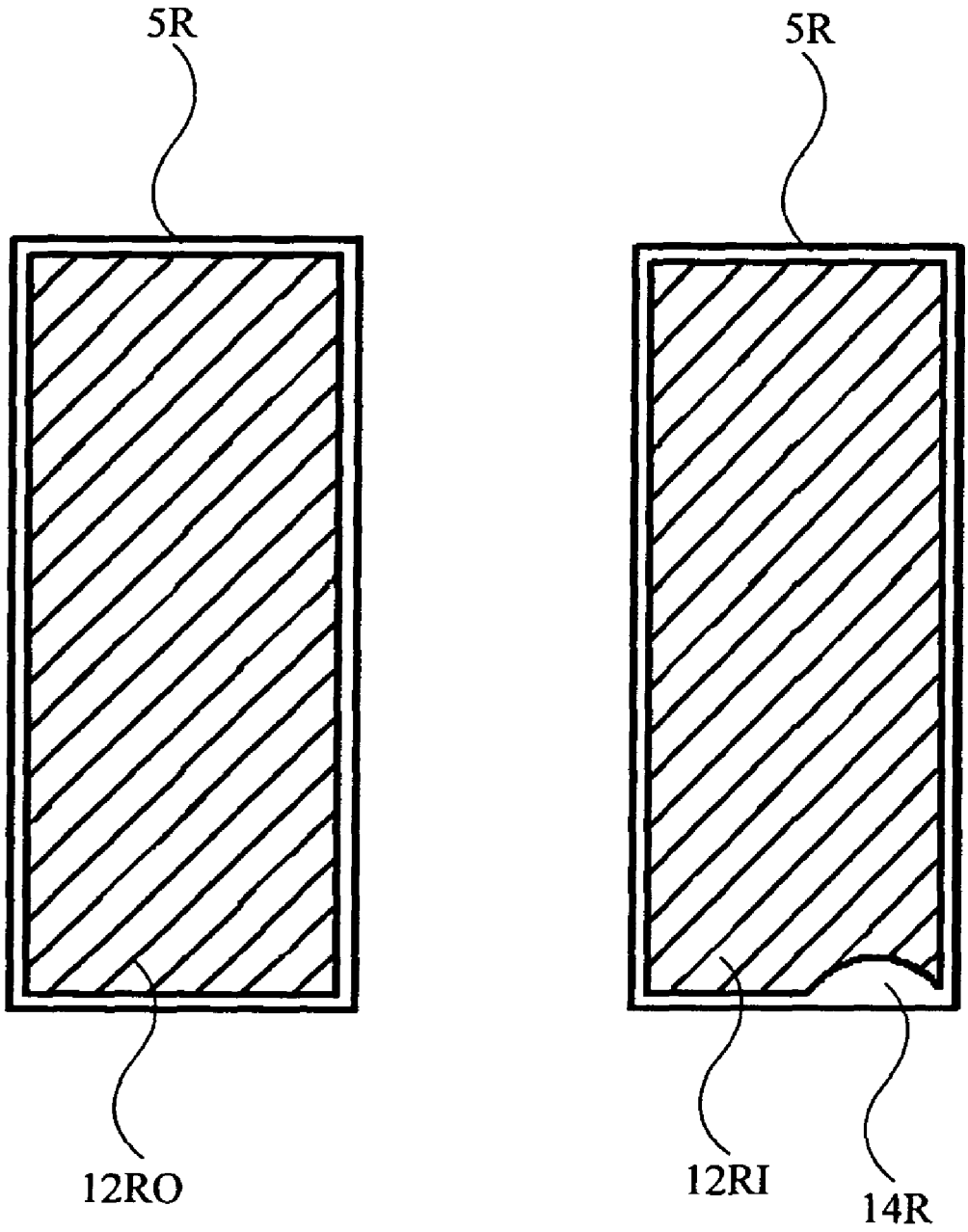
FIG. 5 shows specific structures of a front and a back surfaces of the piezoelectric element 5R mounted on the diaphragm 4R shown in FIG. 2.

In FIG. 5, a silver electrode 12RO is provided on the front surface of the piezoelectric element 5R. On the other hand, a silver electrode 12RI is provided on the adhering surface of the piezoelectric element 5R excluding a portion of area (indentation 14R). The silver electrode 12RI provided on the piezoelectric element 5R is adhered to the diaphragm 4R using, for example, an acrylic adhesive such that the silver electrode 12RI contacts with the area 4Rb conductively connected to the frame 8*d* and the dampers 9Rb. At this time, since the indentation 14R on which the silver electrode 12RI is not provided is formed, the silver electrode 12RI does not contact with the area 4Ra of the diaphragm 4R. That is, even when the piezoelectric element 5R is mounted on the diaphragm 4R, the frame 8*d* and the damper 9Ra are electrically insulated from the silver electrode 12RI.

On the other hand, on a portion of the front surface of each of the piezoelectric elements 5L and 5R mounted on the diaphragms 4L and 4R, respectively, the conductive pastes 11L and 11R are provided (see FIG. 3). Specifically, the conductive paste 11L straddles the front surface of the piezoelectric element 5L and the diaphragm 4L so as to electrically connect, to the area 4La of the diaphragm 4L, the silver electrode 12LO on the front surface of the piezoelectric element 5L mounted on the diaphragm 4L. On the other hand, the conductive paste 11R straddles the front surface of the piezoelectric element 5R and the diaphragm 4R so as to electrically connect, to the area 4Ra of the diaphragm 4R, the silver electrode 12RO on the front surface of the piezoelectric element 5R mounted on the diaphragm 4R. The conductive paste 11L is provided so as to conductively connect the frame 8*b* to the silver electrode 12LO, and the conductive paste 11R is provided so as to conductively connect the frame 8*c* to the silver electrode 12RO. Therefore, separate voltages can be applied to the silver electrode 12LI conductively connected to the frame 8*a*, the silver electrode 12LO conductively connected to the frame 8*b*, the silver electrode 12RO conductively connected to the frame 8*c*, and the silver electrode 12RI conductively connected to the frame 8*d*.

In examples shown in FIG. 4 and FIG. 5, although the silver electrodes 12LI and 12RI include the indentations 14L and 14R, respectively, areas including no silver electrode may be of any shape in which the silver electrodes 12LI and 12RI do not contact with the area 4La of the diaphragm 4L and the area 4Ra of the diaphragm 4R, respectively. For example, the piezoelectric elements 5L and 5R may have the silver electrodes 12LI and 12RI which have rectangular shapes and have margins on the bottom areas thereof so as to prevent the silver electrodes 12LI and 12RI from contacting with the areas 4La and 4Ra, respectively.

Further, the conductive pastes 11L and 11R are portions of the wirings for electrically connecting, to the area 4La of the diaphragm 4L and the area 4Ra of the diaphragm 4R, the silver electrodes 12LO and 12RO formed on the front surface of the piezoelectric elements 5L and 5R, respectively. However, the conductive pastes 11L and 11R may be provided as other components which have such functions. For example, conductive metal films or copper wires may be used to conductively connect the silver electrodes 12LO and 12RO to the areas 4La and 4Ra, respectively.

Further, the silver electrodes 12LO, 12LI, 12RO, and 12RI provided on the piezoelectric elements 5L and 5R may be formed in a method utilizing silver paste or sputtering. Further, the silver electrode 12 is described as an exemplary electrode provided on the piezoelectric elements 5L and 5R. However, the material of the electrode may not be necessarily silver, and another conductive material (for example, a metal) may be used.

Further, since in the above description the front side and the back side of the piezoelectric speaker have the same structure, the structure of the front side (front surface) is mainly described. That is, the laminated material 3 includes, on the front and the back sides thereof, the skin layers 2 of the same patterns which are formed through etching, and the piezoelectric elements 5L and 5R are mounted on both the sides thereof. At this time, the conductive pastes may electrically connect the front side of the piezoelectric speaker to the back side thereof so as to apply the same voltage to both the sides. Specifically, the conductive pastes may be applied to the side surfaces of the respective frames or the like in order to connect the front sides of four separated frames 8*a*, 8*b*, 8*c*, and 8*d* to the backsides thereof, respectively, such that the separation among the frames can be maintained.

Further, the piezoelectric element 5L is mounted on each of the front side and the back side of the aforementioned piezoelectric speaker and the piezoelectric element 5R is mounted on each of the front side and the back side thereof such that the front side and the back side thereof have the same structure. However, the piezoelectric element 5L may be mounted on one of the front side and the back side (for example, the front side) and the piezoelectric element 5R may be mounted on one of the front side and the back side (for example, the front side).

Moreover, although the core layer 1 is exposed so as to form the removed portion 6*e*, the removed portion 6*e* may be made of another material. For example, the removed portion 6*e* may be formed by the core layer 1 corresponding to the removed portion 6*e* being removed and filled with plastic film material which is different from the material of the core layer 1 or rubber high polymer elastomer, having flexibility and Young's modulus of about 1 to 10 MPa, such as rubber including SBR (styrene-butadiene rubber), SBS (styrene-butadiene-styrene rubber), silicone rubber, IIR (butyl rubber), EPM (ethylene propylene rubber), urethane rubber, or a metamorphic body of any of these rubbers.

Furthermore, although in the above description the piezoelectric speaker is described by using the specific shapes and methods in order to give the specific description, these are merely examples, and it is to be understood that the present invention is not restricted to these shapes and methods. For example, the removed portion 6*e*, which is formed through the etching for providing the insulation between the left diaphragm 4L and the right diaphragm 4R, may be of any shape.

Further, although an opening of the speaker is almost square (for example, one side is 35 mm long) as described above as an example, short sides and long sides thereof may have various lengths. On the other hand, the damper 9 and the diaphragms 4L and 4R may have any shape in which the damper 9 can support the diaphragms 4L and 4R such that the diaphragms 4L and 4R linearly vibrate. In addition, although in the present embodiment the piezoelectric elements 5L and 5R each of which is parallelepiped is described as an example, piezoelectric elements of other shapes can be used.

Figure 6:
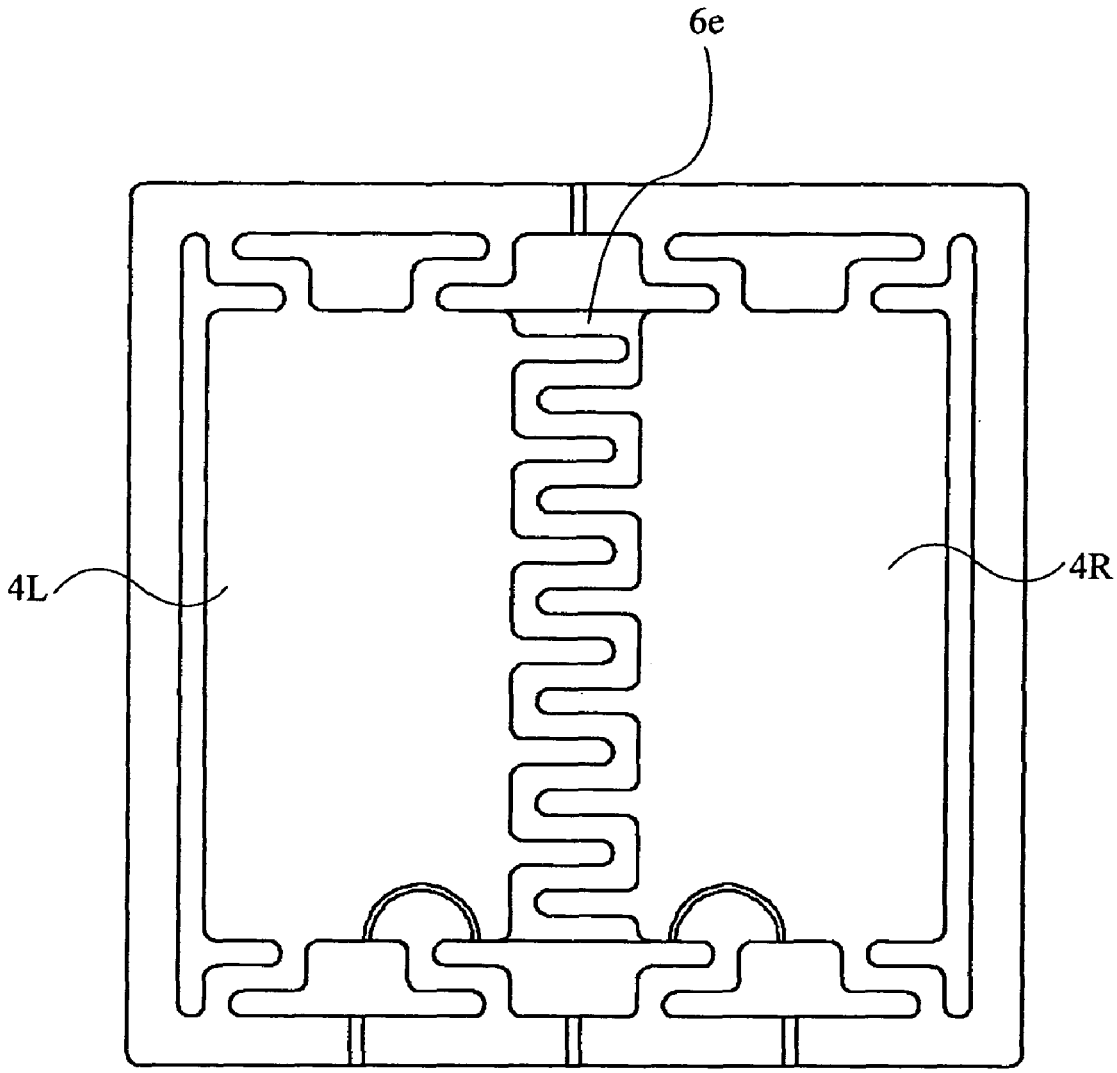
FIG. 6 is a diagram illustrating exemplary shapes of the diaphragm 4L and the diaphragm 4R shown in FIG. 2 in which one side of the diaphragm 4L and one side of the diaphragm 4R, which are adjacent to each other, form a meandering shape.
Figure 7:
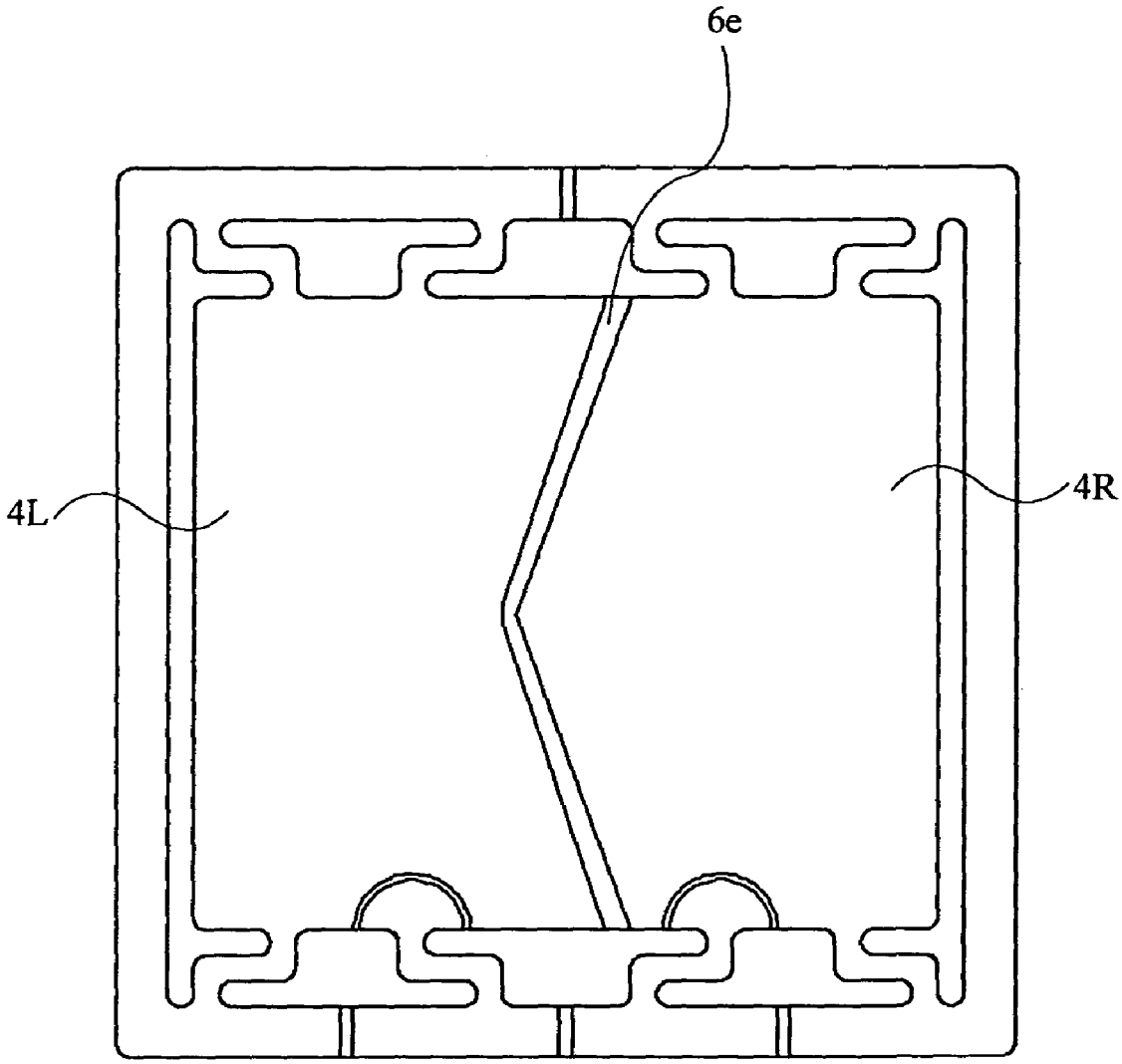
FIG. 7 is a diagram illustrating other exemplary shapes of the diaphragm 4L and the diaphragm 4R shown in FIG. 2 in which one side of the diaphragm 4L and one side of the diaphragm 4R, which are adjacent to each other, forms a dogleg shape.

Moreover, although the diaphragms 4L and 4R each of which is rectangular are described as an example, each of the diaphragms 4L and 4R may have another shape. For example, FIG. 6 shows that one side of the diaphragm 4L and one side of the diaphragm 4R, which are adjacent to each other, form a meandering shape. As another example, FIG. 7 shows that one side of the diaphragm 4L and one side of the diaphragm 4R, which are adjacent to each other, forms a dogleg shape. In any shape, the removed portion 6*e* is formed between the diaphragms 4L and 4R. In an example shown in FIG. 7, the diaphragms 4L and 4R have different shapes from each other. Thus, it is possible to intentionally cause the diaphragms 4L and 4R to have the resonant frequencies different from each other, thereby obtaining the acoustic characteristic representing enhanced smoothness.

Figure 8:
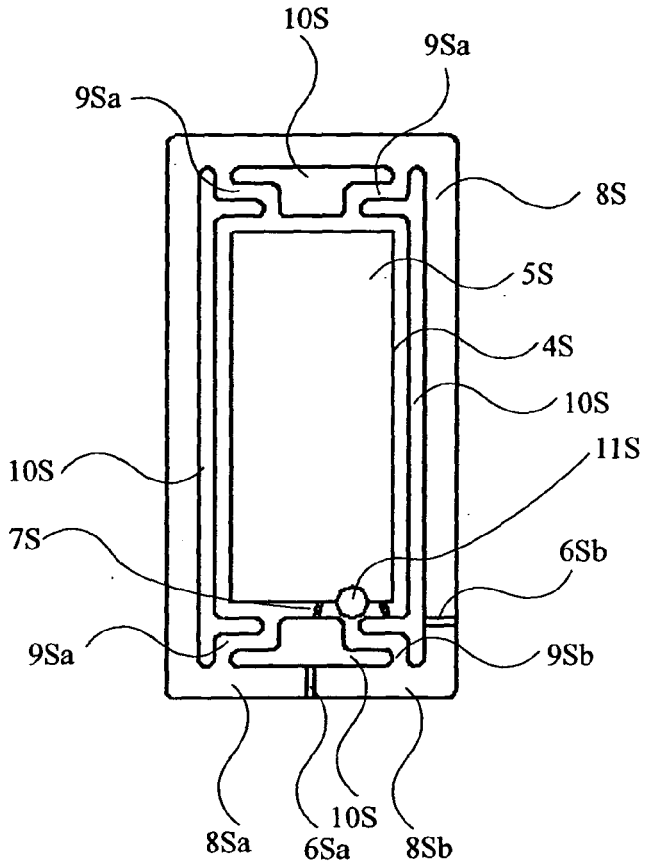
FIG. 8 is a diagram illustrating components of a piezoelectric speaker which is used for a comparison with the piezoelectric speaker shown in FIG. 3.
Figure 9:
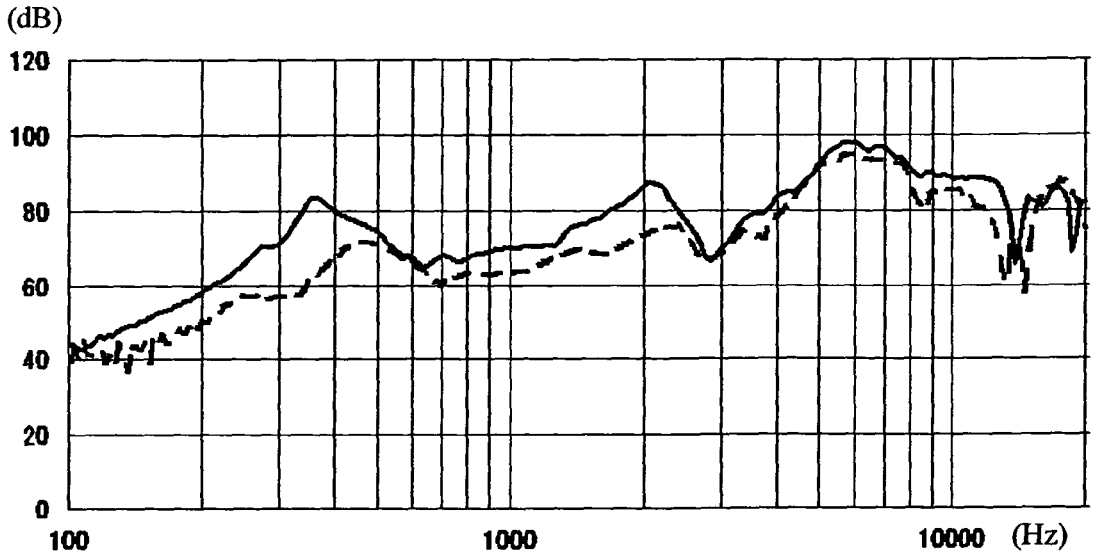
FIG. 9 is a graph showing acoustic characteristics obtained when the piezoelectric speaker shown in FIG. 3 is compared with the piezoelectric speaker shown in FIG. 8.

Next, with reference to FIGS. 8 to 10, the acoustic characteristics of the piezoelectric speaker according to the present embodiment will be described. FIG. 8 is a diagram illustrating components of a piezoelectric speaker used for the comparison with the piezoelectric speaker according to the present embodiment. FIG. 9 is a graph showing the acoustic characteristics obtained when the piezoelectric speaker according to the present embodiment is compared with the piezoelectric speaker shown in FIG. 8. FIG. 10 is a diagram illustrating a result of measuring lowest resonant frequencies f0 (Hz) and the average sound pressures (dB) of the piezoelectric speaker according to the present embodiment and the piezoelectric speaker shown in FIG. 8.

The piezoelectric speaker of the present embodiment is compared with a piezoelectric speaker having, as shown in FIG. 8, a single diaphragm 4S supported by dampers 9Sa and 9Sb so as to be within a frame 8S. The area of the diaphragm 4S is half the area of the diaphragm of the piezoelectric speaker according to the present embodiment (that is, the area of the diaphragm 4S is equal to the area of one of the diaphragms 4L and 4R shown in FIG. 2 and FIG. 3).

In FIG. 9, a solid line in the graph represents the acoustic characteristics obtained by measuring a sound outputted by the piezoelectric speaker according to the present embodiment. Dotted lines in the graph represent the acoustic characteristics obtained by measuring sounds which are simultaneously outputted by two units of piezoelectric speakers shown in FIG. 8. As shown in FIG. 9, the piezoelectric speaker according to the present embodiment has the sound pressure substantially increased, especially, at low frequencies as compared to the piezoelectric speaker shown in FIG. 8. For example, as shown in FIG. 10, while the piezoelectric speaker shown in FIG. 8 satisfies the lowest resonant frequency f0=480 Hz and the average sound pressure=75 dB, the piezoelectric speaker of the present embodiment satisfies the lowest resonant frequency f0=350 Hz and the average sound pressure=80 dB.

This is because, although the area of the diaphragms 4L and 4R are twice the area of the diaphragm 4S, the diaphragms 4L and 4R of the present embodiment allows the removed portion 6*e* to function as a diaphragm at the low-frequency reproduction, which is not achieved by a speaker including two diaphragms 4S which are independent from each other. That is, it can be seen that when the removed portion 6*e* also functions as the diaphragm, an amount of air to be released using amplitudes of vibrations of the diaphragms 4L and 4R is increased, thereby substantially increasing the sound pressure at low frequencies. Further, when a vibration area for one unit is increased by an area corresponding to the removed portion 6*e* at the low frequency reproduction, it can be seen that an amount of vibration is increased and the lowest resonant frequency f0 shifts toward the low frequency side.

Second Embodiment

Figure 11:
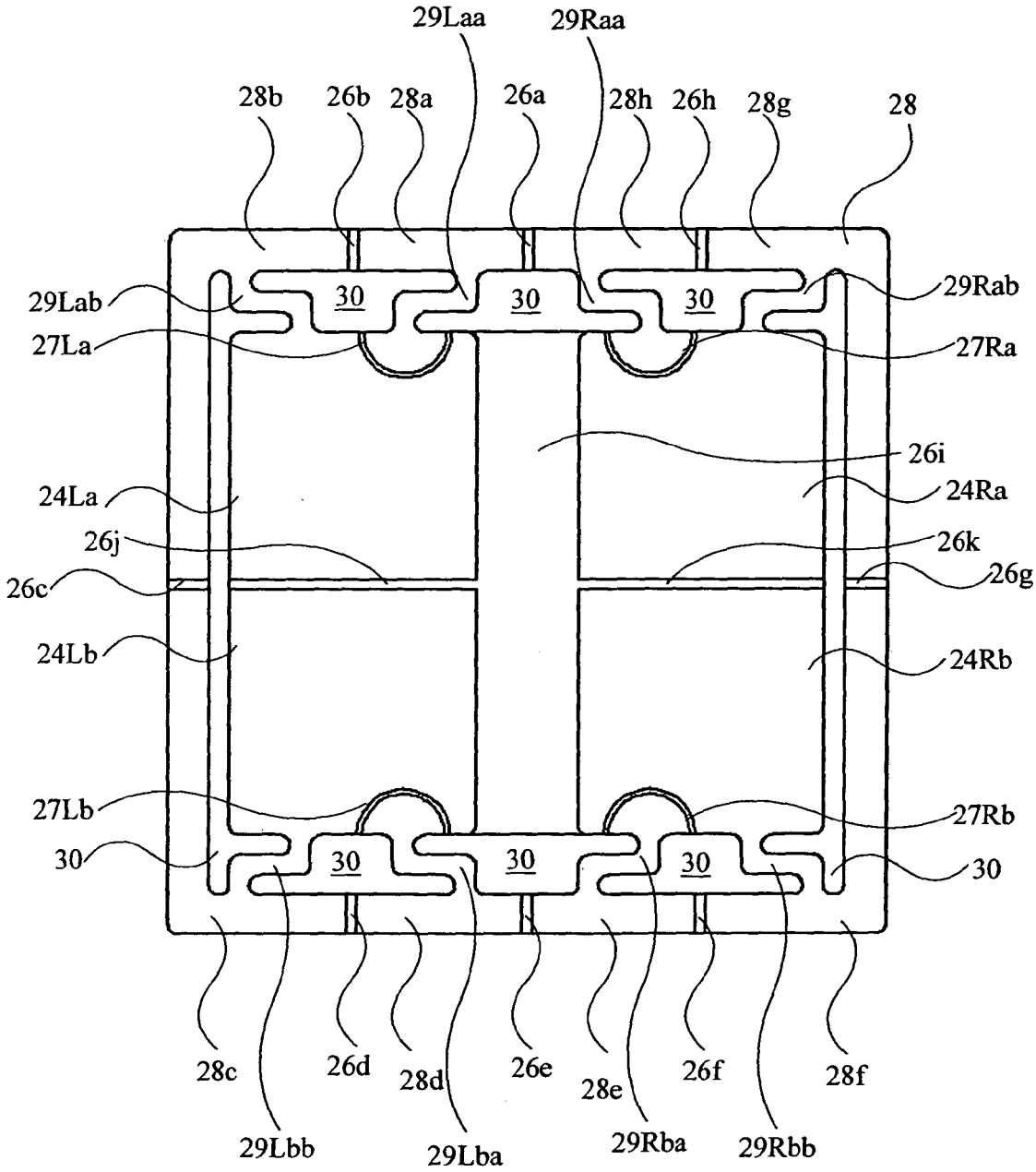
FIG. 11 is a diagram illustrating a front surface of the piezoelectric speaker which does not have a piezoelectric element 25 mounted thereon according to a second embodiment of the present invention.
Figure 12:
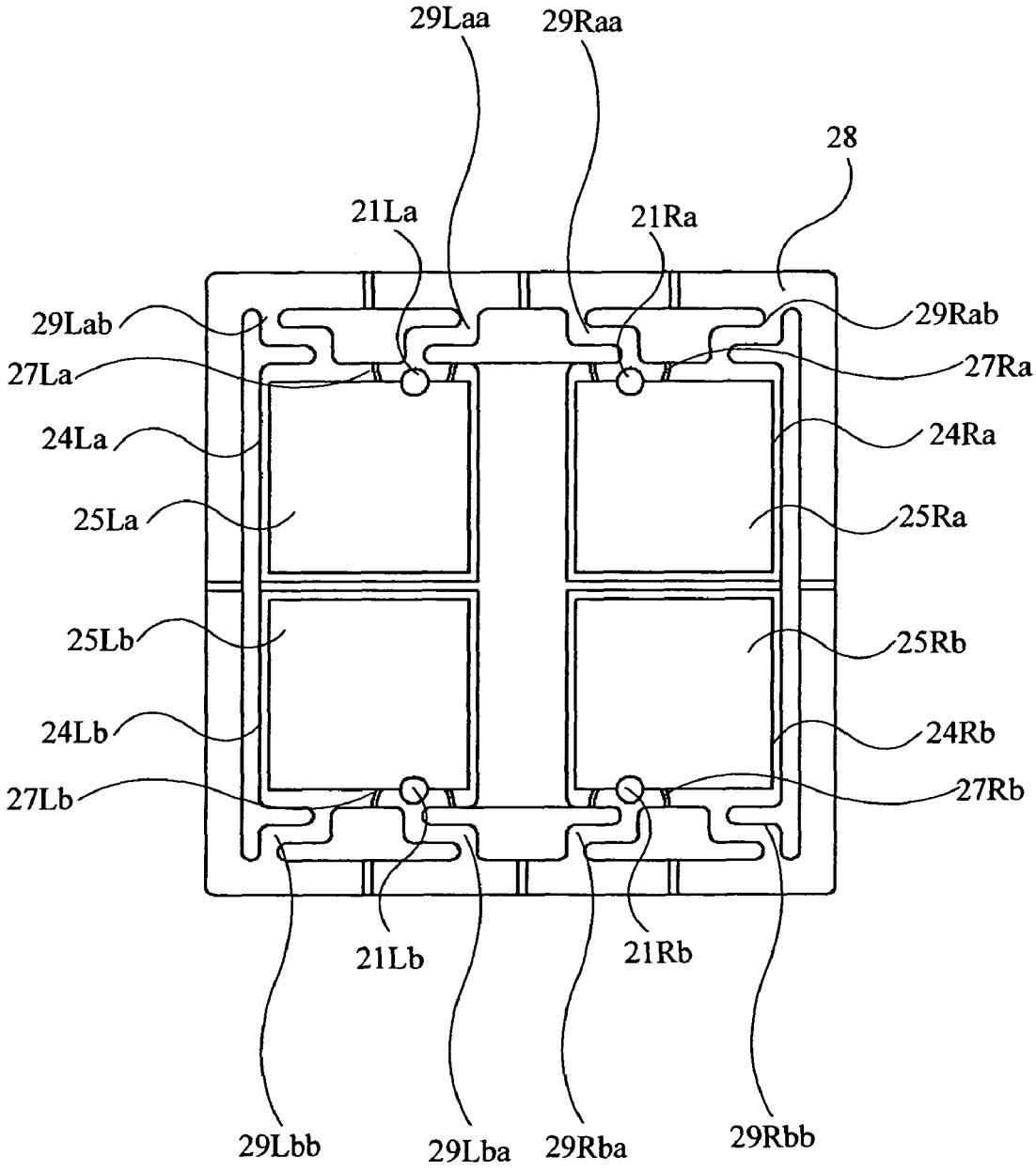
FIG. 12 is a diagram illustrating the front surface of the piezoelectric speaker, shown in FIG. 11, which has the piezoelectric element 25 mounted thereon.

Hereinafter, a piezoelectric speaker according to a second embodiment of the present invention will be described with reference to the drawings. FIG. 11 is a diagram illustrating a front surface of the piezoelectric speaker which does not have a piezoelectric element 25 mounted thereon. FIG. 12 is a diagram illustrating the front surface of the piezoelectric speaker which has the piezoelectric element 25 mounted thereon. The front side and the back side of the piezoelectric speaker have the same structure, and therefore the structure of the front side (front surface) will be mainly described. A cross-sectional structure of a speaker diaphragm for use in the piezoelectric speaker is the same as the structure described for the first embodiment with reference to FIG. 1, and therefore a detailed description thereof is not given.

As shown in FIG. 11 and FIG. 12, the piezoelectric speaker according to the second embodiment has four diaphragms, which are formed by separating each of the left diaphragm 4L and the right diaphragm 4R of the piezoelectric speaker (specifically, the piezoelectric speaker shown in FIG. 2 and FIG. 3) of the first embodiment so as to be disposed one on top of the other and be electrically insulated from each other. According to the second embodiment, the diaphragm 4L of the first embodiment is separated into diaphragms 24La and 24Lb so as to be disposed one on top of the other. According to the second embodiment, the diaphragm 4R of the first embodiment is separated into diaphragms 24Ra and 24Rb so as to be disposed one on top of the other. Further, the diaphragms 24La and 24Lb are supported by a frame 28 through dampers 29Laa and 29Lab, and dampers 29Lba and 29Lbb, respectively. The diaphragms 24Ra and 24Rb are supported by the frame 28 through dampers 29Raa and 29Rab, and dampers 29Rba and 29Rbb, respectively. Further, the piezoelectric elements 25La, 25Lb, 25Ra, and 25Rb are mounted on main surfaces of the diaphragms 24La, 24Lb, 24Ra, and 24Rb, respectively. Conductive pastes 21La, 21Lb, 21Ra, and 21Rb each straddles a portion of the top surface of each of the piezoelectric elements 25La, 25Lb, 25Ra, and 25Rb and a portion of the main surface on which each of the diaphragms 24La, 24Lb, 24Ra, and 24Rb are mounted, respectively. Edges 30 are formed as slits on the four sides of the diaphragms 24La, 24Lb, 24Ra, and 24Rb between the frame 28 and each of the diaphragms 24La, 24Lb, 24Ra, and 24Rb. The aforementioned laminated material 3 of the flat plate is subjected to, for example, etching process and/or pressing process so as to integrally form the diaphragms 24La, 24Lb, 24Ra, and 24Rb, the dampers 29Laa, 29Lab, 29Lba, 29Lbb, 29Raa, 29Rab, 29Rba, and 29Rbb, and the frame 28, as described in the first embodiment, and therefore no detailed description is given except for removed portions and insulating slits. Shapes of the edges 30 and a method for forming the edges 30 are the same as those described for the first embodiment, and therefore no detailed description is given.

As is apparent from FIG. 11 and FIG. 12, each of the dampers 29Laa, 29Lab, 29Lba, 29Lbb, 29Raa, 29Rab, 29Rba, and 29Rbb, which is formed by the skin layer 2, can also function as a portion of an electrode or of an electrical wiring. According to the present embodiment, in order to electrically insulate the dampers 29Laa, 29Lab, 29Lba, 29Lbb, 29Raa, 29Rab, 29Rba, and 29Rbb from each other, a portion of the skin layers 2 of the frame 28, and the diaphragms 24La, 24Lb, 24Ra, and 24Rb are removed through the etching process or the like so as to form removed portions 26*a*, 26*b*, 26*c*, 26*d*, 26*e*, 26*f*, 26*g*, 26*h*, 26*i*, 26*j*, and 26*k*, and insulating slits 27La, 27Lb, 27Ra, and 27Rb. That is, the removed portions 26*a*, 26*b*, 26*c*, 26*d*, 26*e*, 26*f*, 26*g*, 26*h*, 26*i*, 26*j*, and 26*k*, and the insulating slits 27La, 27Lb, 27Ra, and 27Rb are areas in which the core layer 1 is exposed from the laminated material 3, and the areas are boundaries provided for ensuring electrical insulation. The aforementioned removal of the skin layers 2 may be performed simultaneously with the etching process through which the diaphragm 24, the frame 28, and damper 29 are formed.

As shown in FIG. 11 and FIG. 12, the eight removed portions 26*a*, 26*b*, 26*c*, 26*d*, 26*e*, 26*f*, 26*g*, and 26*h* are formed on the frame 28 so as to separate the frame 28 into eight frames 28*a*, 28*b*, 28*c*, 28*d*, 28*e*, 28*f*, 28*g*, and 28*h* which are insulated from each other. The eight frames 28*a*, 28*b*, 28*c*, 28*d*, 28*e*, 28*f*, 28*g*, and 28*h*, which are electrically insulated and separated from each other, are areas which are physically connected to each other through the core layer 1. The frame 28*a*, formed between the removed portions 26*a* and 26*b*, is connected to the diaphragm 24La through the damper 29Laa. The frame 28*b*, formed between the removed portions 26*b* and 26*c*, is connected to the diaphragm 24La through the damper 29Lab. The frame 28*c*, formed between the removed portions 26*c* and 26*d*, is connected to the diaphragm 24Lb through the damper 29Lbb. The frame 28*d*, formed between the removed portions 26*d* and 26*e*, is connected to the diaphragm 24Lb through the damper 29Lba. The frame 28*e*, formed between the removed portions 26*e* and 26*f*, is connected to the diaphragm 24Rb through the damper 29Rba. The frame 28*f*, formed between the removed portions 26*f* and 26*g*, is connected to the diaphragm 24Rb through the damper 29Rbb. The frame 28*g*, formed between the removed portions 26*g* and 26*h*, is connected to the diaphragm 24Ra through the damper 29Rab. The frame 28*h*, formed between the removed portions 26*a* and 26*h*, is connected to the diaphragm 24Ra through the damper 29Raa. As an example shown in FIG. 11 and FIG. 12, the damper 29Laa and the damper 29Raa are disposed adjacent to each other, and the damper 29Lba and the damper 29Rba are disposed adjacent to each other.

The removed portion 26*j* is formed between the diaphragms 24La and 24Lb. On the other hand, the removed portion 26*k* is formed between the diaphragms 24Ra and 24Rb. Although two diaphragms 24La and 24Lb are electrically insulated and separated from each other, these components are physically connected to each other through the core layer 1. On the other hand, although two diaphragms 24Ra and 24Rb are electrically insulated and separated from each other, these components are physically connected to each other through the core layer 1.

Further, a removed portion 26*i* is formed between the diaphragms 24La and 24Lb and the diaphragms 24Ra and 24Rb. The removed portion 26*i* is the same as the removed portion 6*e* of the first embodiment, and therefore no detailed description is given. That is, the removed portion 26*i* functions as a diaphragm at the low-frequency reproduction and functions as an edge at the high-frequency reproduction.

The insulating slit 27La is formed on the diaphragm 24La adjacent to an area connecting to the damper 29Laa, so as to separate the diaphragm 24La into two areas (hereinafter, referred to as an area 24Laa and an area 24Lab) which are insulated from each other. The insulating slit 27La separates the diaphragm 24La into the area 24Laa connected to the frame 28*a* through the damper 29Laa and the area 24Lab connected to the frame 28*b* through the damper 29Lab. Although the diaphragm 24La is separated into the two areas 24Laa and 24Lab which are electrically insulated from each other by the insulating slit 27La, the two areas are physically connected to each other through the core layer 1. On the other hand, the insulating slit 27Lb is formed on the diaphragm 24Lb adjacent to an area connecting to the damper 29Lba, so as to separate the diaphragm 24Lb into two areas (hereinafter, referred to as an area 24Lba and an area 24Lbb) which are insulated from each other. The insulating slit 27Lb separates the diaphragm 24Lb into the area 24Lba connected to the frame 28*d* through the damper 29Lba and the area 24Lbb connected to the frame 28*c* through the damper 29Lbb. Although the diaphragm 24Lb is separated into the two areas 24Lba and 24Lbb which are electrically insulated from each other by the insulating slit 27Lb, the two areas are physically connected to each other through the core layer 1.

On the other hand, the insulating slit 27Ra is formed on the diaphragm 24Ra adjacent to an area connecting to the damper 29Raa, so as to separate the diaphragm 24Ra into two areas (hereinafter, referred to as an area 24Raa and an area 24Rab) which are insulated from each other. The insulating slit 27Ra separates the diaphragm 24Ra into the area 24Raa connected to the frame 28*h* through the damper 29Raa and the area 24Rab connected to the frame 28*g* through the damper 29Rab. Although the diaphragm 24Ra is separated into the two areas 24Raa and 24Rab which are electrically insulated from each other by the insulating slit 27Ra, the two areas are physically connected to each other through the core layer 1. On the other hand, the insulating slit 27Rb is formed on the diaphragm 24Rb adjacent to an area connecting to the damper 29Rba, so as to separate the diaphragm 24Rb into two areas (hereinafter, referred to as an area 24Rba and an area 24Rbb) which are insulated from each other. The insulating slit 27Rb separates the diaphragm 24Rb into the area 24Rba connected to the frame 28*e* through the damper 29Rba and the area 24Rbb connected to the frame 28*f* through the damper 29Rbb. Although the diaphragm 24Rb is separated into the two areas 24Rba and 24Rbb which are electrically insulated from each other by the insulating slit 27Rb, the two areas are physically connected to each other through the core layer 1.

The removed portions 26*a*, 26*b*, 26*c*, 26*d*, 26*e*, 26*f*, 26*g*, 26*h*, 26*i*, 26*j*, and 26*k* and the insulating slits 27La, 27Lb, 27Ra, and 27Rb are formed so as to insulate the damper 29Laa and the frame 28*a* connected to the diaphragm 24La, the damper 29Lab and the frame 28*b* connected to the diaphragm 24La, the damper 29Lbb and the frame 28*c* connected to the diaphragm 24Lb, the damper 29Lba and the frame 28*d* connected to the diaphragm 24Lb, the damper 29Rba and the frame 28*e* connected to the diaphragm 24Rb, the damper 29Rbb and the frame 28*f* connected to the diaphragm 24Rb, the damper 29Rab and the frame 28*g* connected to the diaphragm 24Ra, and the damper 29Raa and the frame 28*h* connected to the diaphragm 24Ra, from each other, whereby it is possible to apply separate voltages thereto.

A silver electrode 32 (not shown) is provided on the front surface of each of the piezoelectric elements 25La, 25Lb, 25Ra, and 25Rb. Further, the silver electrode 32 (not shown) is provided on the adhering surface of each of the piezoelectric elements 25La, 25Lb, 25Ra, and 25Rb excluding areas contacting with the areas 24Laa, 24Lba, 24Raa, and 24Rba. The piezoelectric elements 25La, 25Lb, 25Ra, and 25Rb are adhered to the diaphragms 24La, 24Lb, 24Ra, and 24Rb, respectively, using, for example, an acrylic adhesive such that the silver electrode 32 provided on the adhering surface thereof contacts with each of the areas 24Lab, 24Lbb, 24Rab, and 24Rbb. At this time, the silver electrode 32 provided on the adhering surface thereof does not contact with each of the areas 24Laa, 24Lba, 24Raa, and 24Rba.

Further, the conductive paste 21La straddles the diaphragm 24La and the front surface of the piezoelectric element 25La so as to electrically connect, to the area 24Laa of the diaphragm 24La, the silver electrode 32 on the front surface of the piezoelectric element 25La mounted on the diaphragm 24La. The conductive paste 21Lb straddles the diaphragm 24Lb and the front surface of the piezoelectric element 25Lb so as to electrically connect, to the area 24Lba of the diaphragm 24Lb, the silver electrode 32 on the front surface of the piezoelectric element 25Lb mounted on the diaphragm 24Lb. The conductive paste 21Ra straddles the diaphragm 24Ra and the front surface of the piezoelectric element 25Ra so as to electrically connect, to the area 24Raa of the diaphragm 24Ra, the silver electrode 32 on the front surface of the piezoelectric element 25Ra mounted on the diaphragm 24Ra. The conductive paste 21Rb straddles the diaphragm 24Rb and the front surface of the piezoelectric element 25Rb so as to electrically connect, to the area 24Rba of the diaphragm 24Rb, the silver electrode 32 on the front surface of the piezoelectric element 25Rb mounted on the diaphragm 24Rb. The conductive pastes 21La, 21Lb, 21Ra, and 21Rb are provided so as to enable separate voltages to be applied to the silver electrode 32 on the front surface of the diaphragm 24La conductively connected to the frame 28*a*, the silver electrode 32 on the adhering surface of the diaphragm 24La conductively connected to the frame 28*b*, the silver electrode 32 on the front surface of the diaphragm 24Lb conductively connected to the frame 28*c*, the silver electrode 32 on the adhering surface of the diaphragm 24Lb conductively connected to the frame 28*d*, the silver electrode 32 on the front surface of the diaphragm 24Ra conductively connected to the frame 28*h*, the silver electrode 32 on the adhering surface of the diaphragm 24Ra conductively connected to the frame 28*g*, the silver electrode 32 on the front surface of the diaphragm 24Rb conductively connected to the frame 28*f*, and the silver electrode 32 on the adhering surface of the diaphragm 24Rb conductively connected to the frame 28*e*. That is, the frame 28 is subjected to the etching process so as to also serve as external electrodes of the four diaphragms 24La, 24Lb, 24Ra, and 24Rb at eight positions (28*a*, 28*b*, 28*c*, 28*d*, 28*e*, 28*f*, 28*g*, and 28*h*: serve as + poles and – poles at total eight positions).

Figure 13:
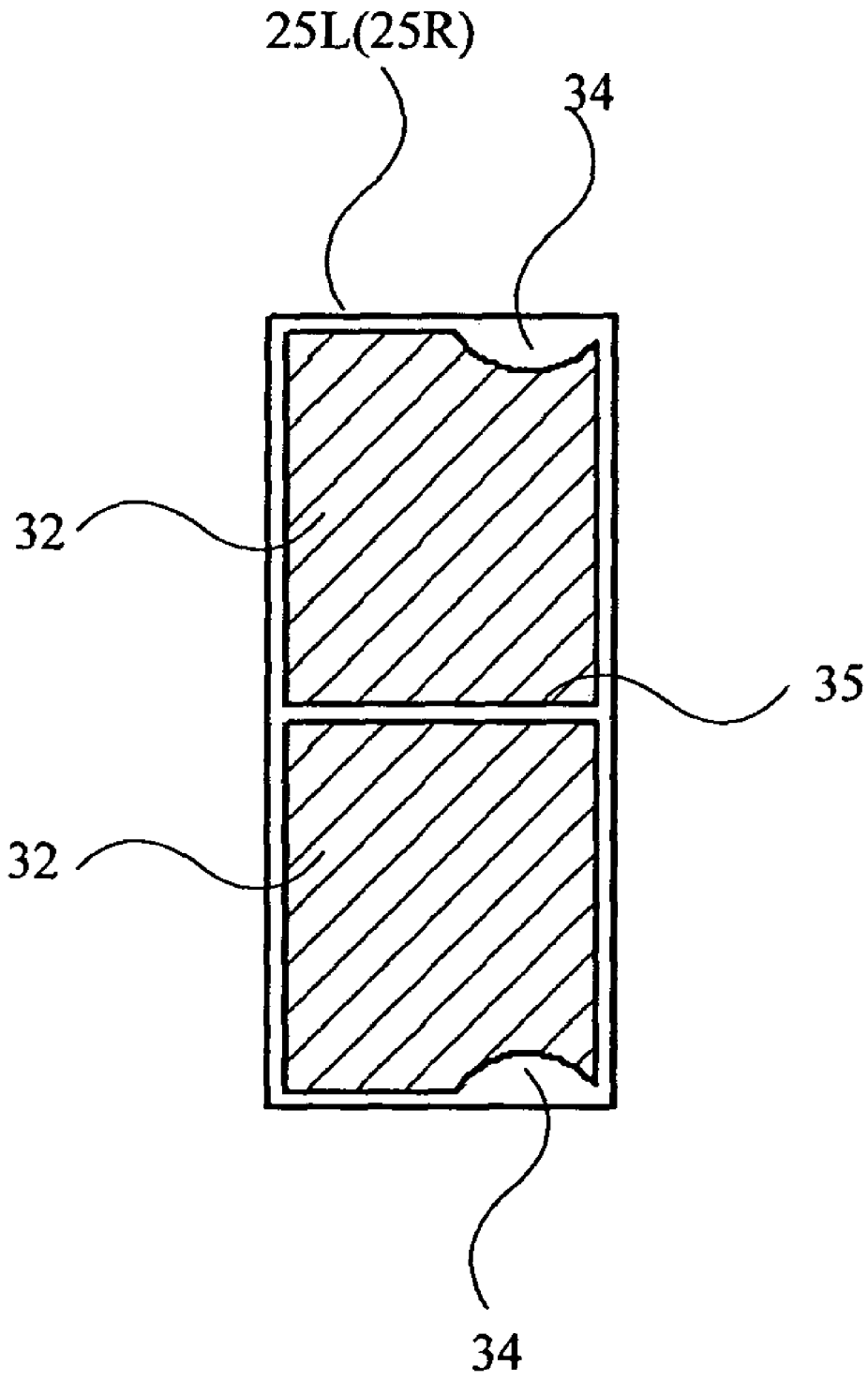
FIG. 13 is a diagram illustrating a piezoelectric element 25L to be adhered to a diaphragm 24La and a diaphragm 24Lb, shown in FIG. 11, which are separated so as to be disposed one on top of the other, and a piezoelectric element 25R to be adhered to a diaphragm 24Ra and a diaphragm 24Rb, shown in FIG. 11, which are separated so as to be disposed one on top of the other.

As shown in FIG. 12, the four piezoelectric elements 25La, 25Lb, 25Ra, and 25Rb, which are shaped so as to correspond to the diaphragms 24La, 24Lb, 24Ra, and 24Rb, may be adhered to the corresponding diaphragms, respectively. Alternatively, the diaphragms 24La and 24Lb which are separated so as to be disposed one on top of the other has one piezoelectric element adhered thereto, and the diaphragms 24Ra and 24Rb which are separated so as to be disposed one on top of the other has one piezoelectric element adhered thereto, as with the piezoelectric elements 25L (25R) shown in FIG. 13. In this case, the silver electrode 32 including an indentation 34 which does not contact with each of the areas 24Laa and 24Lba (24Raa and 24Rba) is provided on the adhering surface of the piezoelectric element 25L (25R). The silver electrode 32 is separated into an upper and a lower portions by forming an insulting portion 35 at the center thereof such that the silver electrode 32 on the adhering surface of the piezoelectric element 25L (25R) contacts with only the areas 24Lab and 24Lbb (24Rab and 24Rbb). Thus, the piezoelectric speaker according to the present embodiment can be structured so as to include the four piezoelectric elements 25La, 25Lb, 25Ra, and 25Rb.

Figure 14:
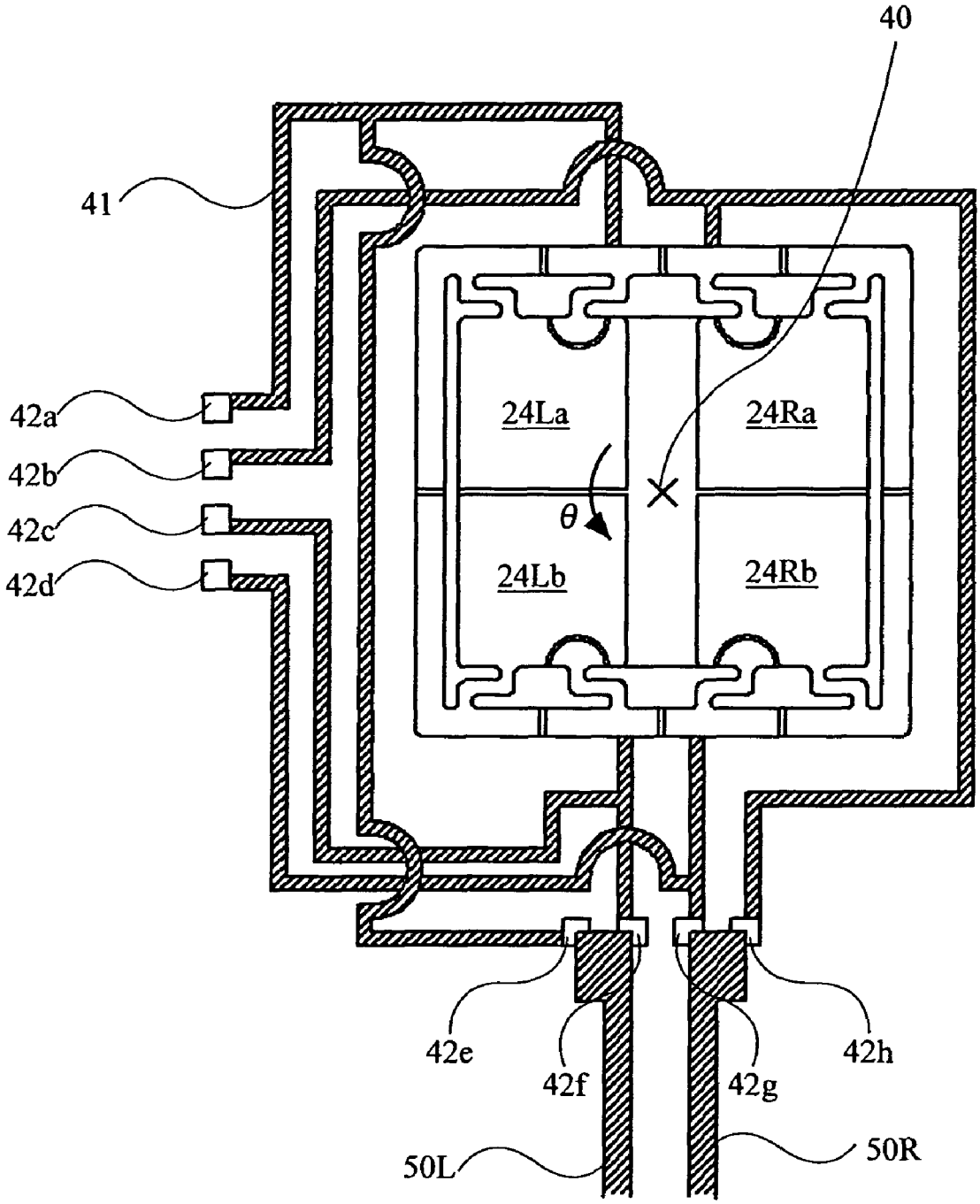
FIG. 14 is a diagram illustrating an example where the piezoelectric speaker shown in FIG. 12 is connected to an external wiring and mounted in the first direction.
Figure 15:
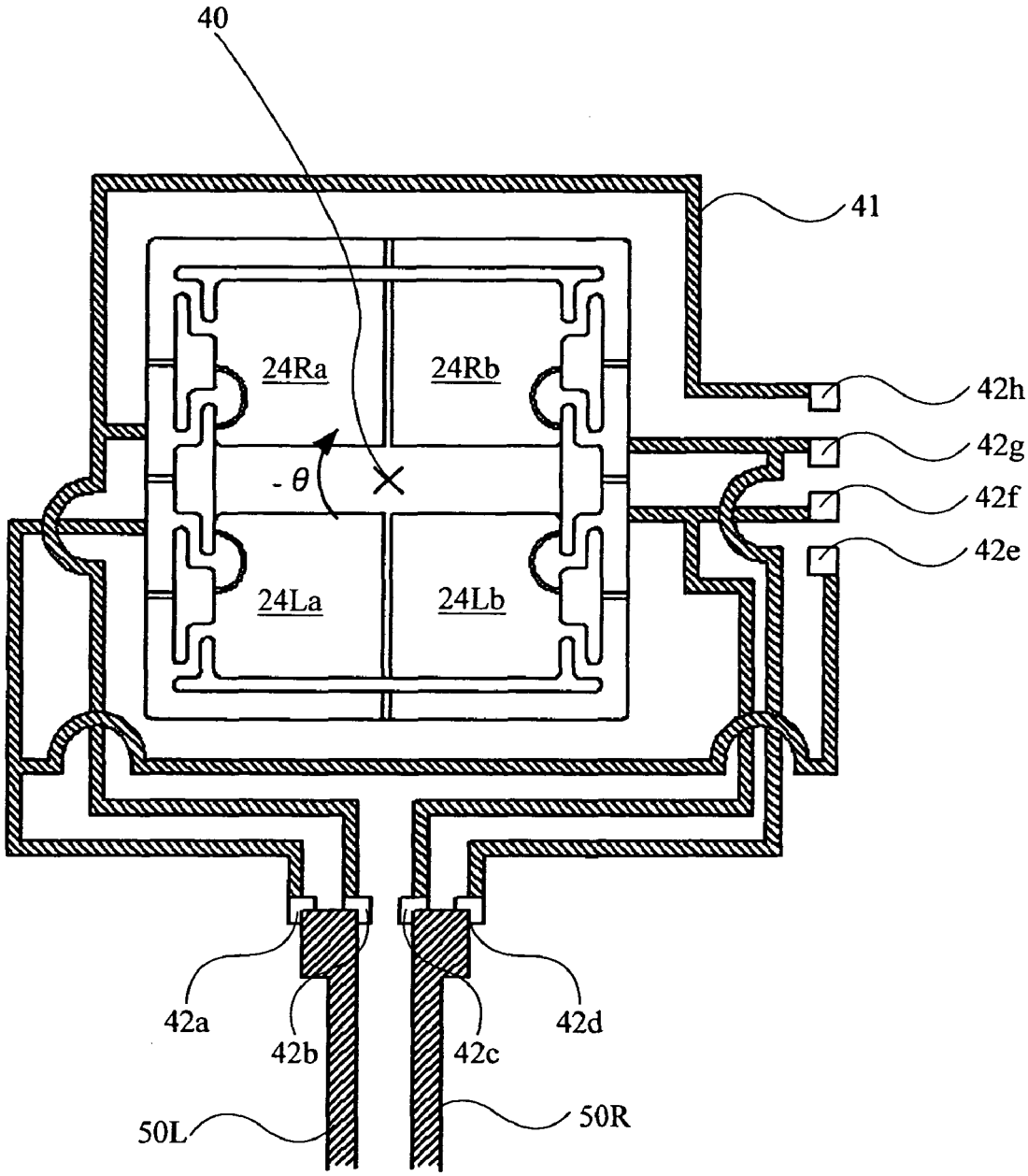
FIG. 15 is a diagram illustrating an example where the piezoelectric speaker shown in FIG. 12 is connected to the external wiring and mounted in the second direction.

Next, an example where the piezoelectric speaker according to the second embodiment is connected to an external wiring and mounted on a device such as a compact mobile device will be described. FIG. 14 is a diagram illustrating an example where the piezoelectric speaker is connected to an external wiring and mounted in the first direction. FIG. 15 is a diagram illustrating an example where the piezoelectric speaker is connected to the external wiring and mounted in the second direction. In FIG. 14 and FIG. 15, for clear description, the piezoelectric element 25 and the conductive paste 21 are not shown, and an input (wiring) to the ground is not shown.

In FIG. 14, the frames 28*a*, 28*b*, 28*c*, 28*d*, 28*e*, 28*f*, 28*g*, and 28*h* are connected to a wiring 41. The piezoelectric speaker connected to the wiring 41 is mounted so as to be rotatable about a rotation axis 40 in the direction of θ shown in figure together with the wiring 41. On the other hand, stationary terminals 50L and 50R are fixedly mounted so as to be connectable to any of terminals 42*a*, 42*b*, 42*c*, 42*d*, 42*e*, 42*f*, 42*g*, and 42*h* included in the wiring 41. The stationary terminals 50L and 50R, formed as components which are separated from the piezoelectric speaker and the wiring 41, are not rotated together with the piezoelectric speaker and the wiring 41.

For example, the wiring 41 is formed on a substrate or inside the substrate. When the piezoelectric speaker shown in FIG. 11 is manufactured using the etching process, the etching process is performed such that a wiring pattern of the wiring 41 is formed in an outer periphery area of the piezoelectric speaker, thereby enabling the wiring 41 to be simultaneously formed in the manufacturing process of the piezoelectric speaker. Needless to say, the wiring 41 may be formed separately from the piezoelectric speaker.

The terminals 42*a*, 42*b*, 42*c*, and 42*d* included in the wiring 41 are mounted in line at regular intervals. Further, the terminals 42*e*, 42*f*, 42*g*, and 42*h* included in the wiring 41 are mounted in line at the same regular intervals as those for the terminals 42*a*, 42*b*, 42*c*, and 42*d*. When the piezoelectric speaker and the wiring 41 are oriented in the first direction (a state shown in FIG. 14), the diaphragms 24La and 24Lb are disposed one on top of the other to the left of the rotation axis 40, and the diaphragms 24Ra and 24Rb are disposed one on top of the other to the right of the rotation axis 40. Further, when oriented in the first direction, the terminals 42*a*, 42*b*, 42*c*, and 42*d* are disposed to the left of the rotation axis 40, and the terminals 42*e*, 42*f*, 42*g*, and 42*h* are disposed below the rotation axis 40. That is, the terminals 42*e*, 42*f*, 42*g*, and 42*h* are mounted at positions corresponding to positions of the respective terminals 42*a*, 42*b*, 42*c*, and 42*d* which have been rotated 90 degrees in the direction of θ about the rotation axis 40 used as a reference. When the piezoelectric speaker and the wiring 41 are oriented in the first direction, the stationary terminal 50L contacts with the terminals 42*e* and 42*f*, and the stationary terminal 50R contacts with the terminals 42*g* and 42*h*. The terminals 42*a*, 42*b*, 42*c*, and 42*d* do not contact with other terminals.

As shown in FIG. 14, the frame 28*a* is connected to the terminals 42*a* and 42*e* through the wiring pattern of the wiring 41. The frame 28*h* is connected to the terminals 42*b* and 42*h* through the wiring pattern of the wiring 41. The frame 28*d* is connected to the terminals 42*c* and 42*f* through the wiring pattern of the wiring 41. The frame 28*e* is connected to the terminals 42*d* and 42*g* through the wiring pattern of the wiring 41.

An audio signal of an L channel is outputted from the stationary terminal 50L. On the other hand, an audio signal of an R channel is outputted from the stationary terminal 50R. Accordingly, when oriented in the first direction, the audio signal of the L channel is inputted to the frame 28*a* through the stationary terminal 50L and the terminal 42*e*, and the audio signal of the L channel is inputted to the frame 28*d* through the stationary terminal 50L and the terminal 42*f*. The audio signal of the L channel is transmitted to the silver electrode 32 of each of the front surfaces of the piezoelectric elements 25La and 25Lb mounted on the respective diaphragms 24La and 24Lb. Moreover, when oriented in the first direction, the audio signal of the R channel is inputted to the frame 28*h* through the stationary terminal 50R and the terminal 42*h*, and the audio signal of the R channel is inputted to the frame 28*e* through the stationary terminal 50R and the terminal 42*g*. The audio signal of the R channel is transmitted to the silver electrode 32 of each of the front surfaces of the piezoelectric elements 25Ra and 25Rb mounted on the respective diaphragms 24Ra and 24Rb. Accordingly, the diaphragms 24La and 24Lb are used as a left speaker, and the diaphragms 24Ra and 24Rb are used as a right speaker so as to enable a stereo reproduction.

On the other hand, FIG. 15 shows a state where the piezoelectric speaker and the wiring 41 are rotated 90 degrees in the direction of θ from the first direction as shown in FIG. 14 so as to be oriented in the second direction. When the piezoelectric speaker and the wiring 41 are oriented in the second direction as shown in FIG. 15, the diaphragms 24Ra and 24La are disposed one on top of the other to the left of the rotation axis 40, and the diaphragms 24Rb and 24Lb are disposed one on top of the other to the right of the rotation axis 40. Further, when oriented in the second direction, the terminals 42*a*, 42*b*, 42*c*, and 42*d* are disposed below the rotation axis 40, and the terminals 42*e*, 42*f*, 42*g*, and 42*h* are disposed to the right of the rotation axis 40. When the piezoelectric speaker and the wiring 41 are oriented in the second direction, the stationary terminal 50L contacts with the terminals 42*a* and 42*b*, and the stationary terminal 50R contacts with the terminals 42*c* and 42*d*. The terminals 42*e*, 42*f*, 42*g*, and 42*h* do not contact with other terminals.

When oriented in the second direction, as in the first direction, the stationary terminal 50L outputs an audio signal of the L channel, and the stationary terminal 50R outputs an audio signal of the R channel. Accordingly, when oriented in the second direction, the audio signal of the L channel is inputted to the frame 28*a* through the stationary terminal 50L and the terminal 42*a*, and the audio signal of the L channel is inputted to the frame 28*h* through the stationary terminal 50L and the terminal 42*b*. The audio signal of the L channel is transmitted to the silver electrode 32 of each of the front surfaces of the piezoelectric elements 25La and 25Ra mounted on the respective diaphragms 24La and 24Ra. Moreover, when oriented in the second direction, the audio signal of the R channel is inputted to the frame 28*d* through the stationary terminal 50R and the terminal 42*c*, and the audio signal of the R channel is inputted to the frame 28*e* through the stationary terminal 50R and the terminal 42*d*. The audio signal of the R channel is transmitted to the silver electrode 32 of each of the front surfaces of the piezoelectric elements 25Lb and 25Rb mounted on the respective diaphragms 24Lb and 24Rb. Accordingly, the diaphragms 24La and 24Ra are used as a left speaker, and the diaphragms 24Lb and 24Rb are used as a right speaker so as to enable a stereo reproduction.

In a conventional art, the diaphragms 24La and 24Lb used for reproduction of a left channel are stationary, and the diaphragms 24Ra and 24Rb used for reproduction of a right channel are stationary, and therefore, for example, when the piezoelectric speaker in a state shown in FIG. 14 is rotated in the direction of θ together with the stationary terminals 50L and 50R, the rotation leads to an acoustic discomfort, thereby preventing an effective stereo reproduction. However, according to the present embodiment, only the piezoelectric speaker and the wiring 41 are rotated 90 degrees so as to connect the stationary terminals 50L and 50R to one of two sets of terminals (42*a*, 42*b*, 42*c* and 42*d*, and 42*e*, 42*f*, 42*g* and 42*h*) connected to the piezoelectric speaker by switching between the two sets of terminals. Thus, when oriented in the first direction, signals of the stationary terminal 50L of the left channel are transmitted to the terminals 42*e* and 42*f*, and signals of the stationary terminal 50R of the right channel are transmitted to the terminals 42*g* and 42*h*. On the other hand, when oriented in the second direction, signals of the stationary terminal 50L of the left channel are transmitted to the terminals 42*a* and 42*b*, and signals of the stationary terminal 50R of the right channel are transmitted to the terminals 42*c* and 42*d*. A switching among the terminals 42*a*, 42*b*, 42*c*, 42*d*, 42*e*, 42*f*, 42*g*, and 42*h* to be connected to the stationary terminals 50L and 50R is performed, and therefore, even when the piezoelectric speaker is rotated, an effective stereo reproduction is realized. When the above-described structure is used, even when the piezoelectric speaker is rotated 90 degrees, an effective stereo reproduction can be maintained without involving the acoustic discomfort.

In order to perform connecting terminal switch-over as described above, a detection means (not shown) is provided for detecting whether a device having the piezoelectric speaker and the wiring 41 mounted thereon is oriented upward or downward, and whether the connection as shown in FIG. 14 is provided or the connection as shown in FIG. 15 is provided may be determined in accordance with the detected direction. At this time, the switchover among the connecting terminals may be mechanically performed or electronically performed. Further, although FIG. 14 and FIG. 15 show that one of the terminals 42*a*, 42*b*, 42*c*, and 42*d*, and the terminals 42*e*, 42*f*, 42*g*, and 42*h* is not connected to other terminals, all the terminals 42*a*, 42*b*, 42*c*, 42*d*, 42*e*, 42*f*, 42*g*, and 42*h* may be connected to other stationary terminals, and the switchover of input signals to the wiring 41 may be performed using another mechanism.

Moreover, the aforementioned detection means may not be provided. For example, the stationary terminals 50L and 50R are provided in a device body, and the piezoelectric speaker and the wiring 41 are provided in another casing including a display screen. The casing including the display screen, the piezoelectric speaker, and the wiring 41 can be rotated, with respect to the body, about the rotation axis 40 in the first direction or the second direction. In this structure, when a user is allowed to view moving pictures in both the vertical direction and the horizontal direction by rotating the display screen with respect to the body, an effective stereo reproduction is performed in accordance with whether the casing is oriented in the first direction or the second direction with respect to the body. In this structure, when the piezoelectric speaker according to the present embodiment is mounted on, for example, a device such as a mobile telephone and a PDA, the effective stereo reproduction can be maintained regardless of a usage method, that is, whether the device is vertically oriented or horizontally oriented in accordance with an application being executed in the device.

As described above, the piezoelectric speaker according to the second embodiment is constructed such that an acoustic discomfort caused at the stereo reproduction due to the device being oriented vertically and horizontally can be eliminated, and one speaker unit can collectively provide functions which are usually provided by three speakers, or functions which are usually performed by four or more speakers. Further, as with the first embodiment, the piezoelectric speaker capable of broadening a low-frequency reproduction bandwidth and increasing sound pressure can be provided.

Third Embodiment

Figure 16:
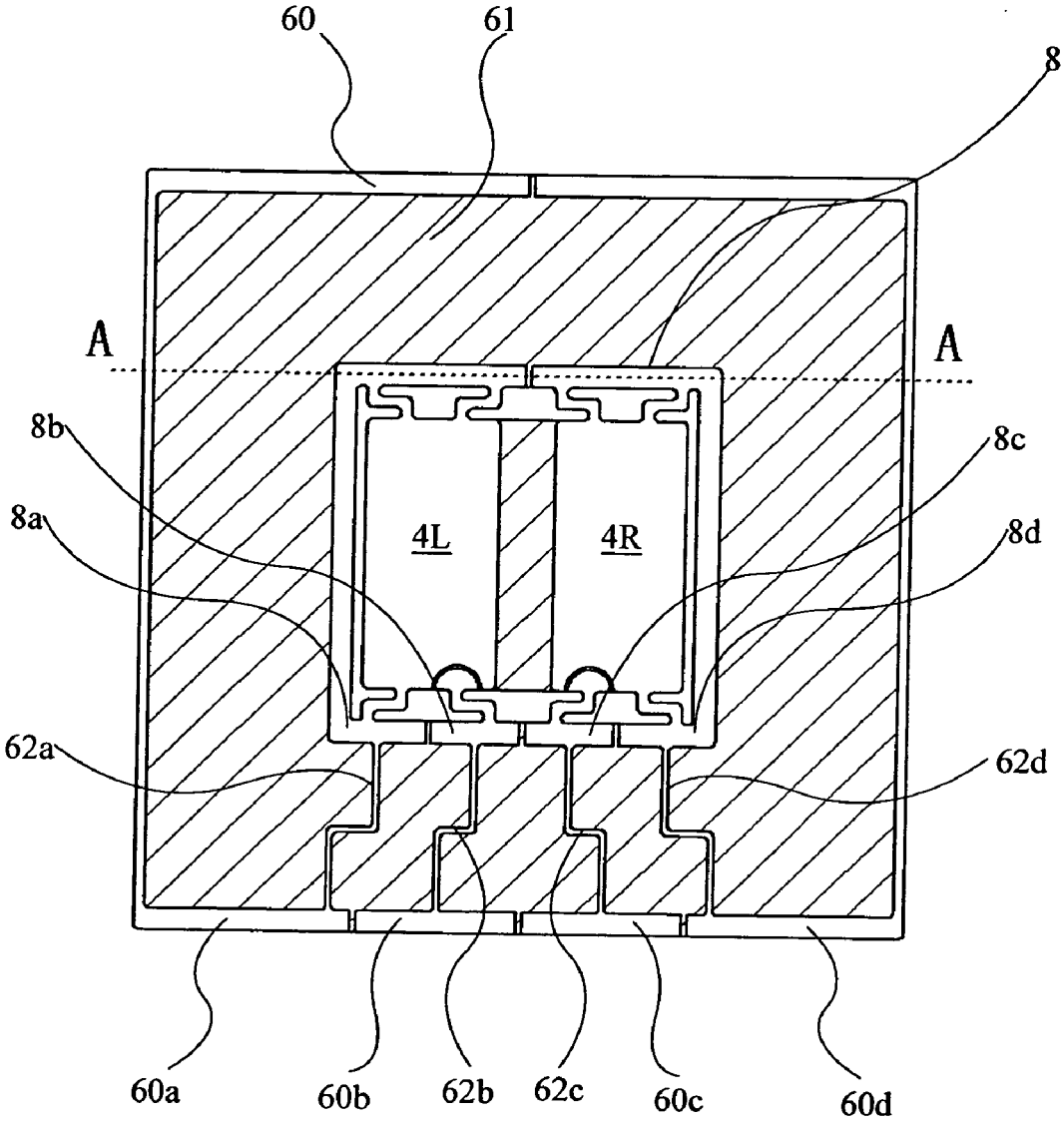
FIG. 16 is a diagram illustrating a front surface of a piezoelectric speaker which does not have the piezoelectric element 5 mounted thereon according to a third embodiment of the present invention.
Figure 17:
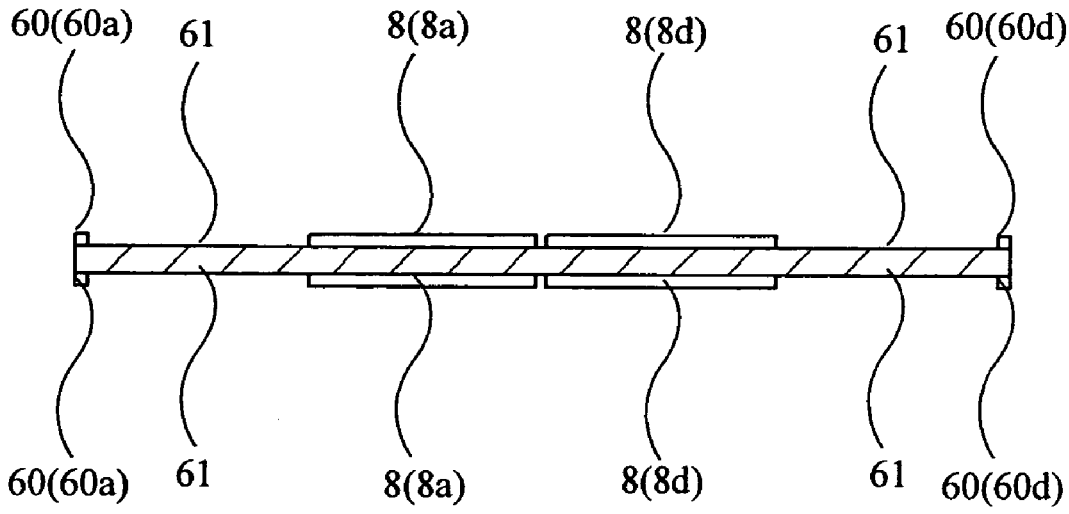
FIG. 17 is a cross-sectional view illustrating a structure of a section AA of the piezoelectric speaker shown in FIG. 16.
Figure 18:
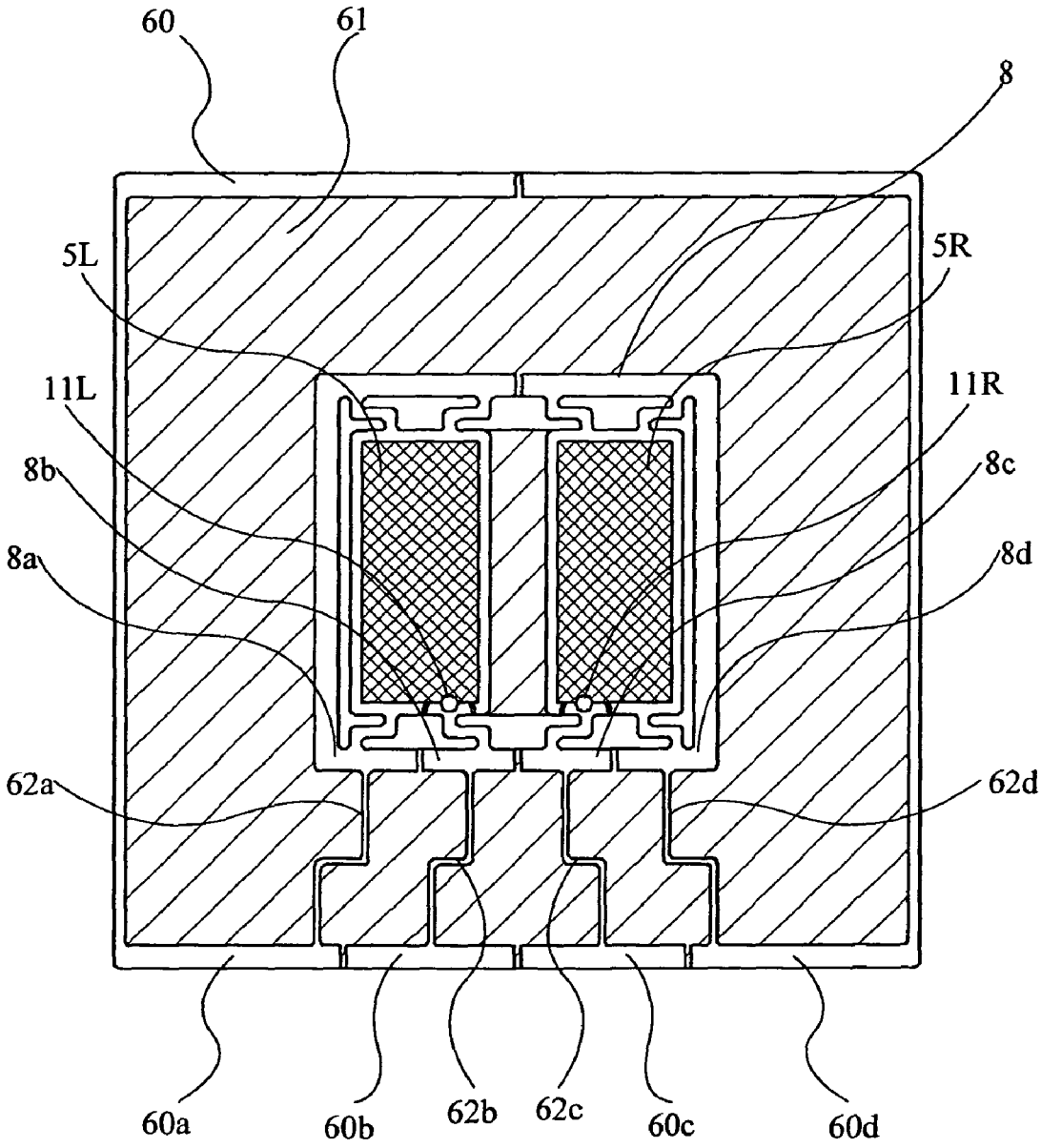
FIG. 18 is a diagram illustrating the front surface of the piezoelectric speaker, shown in FIG. 16, which has the piezoelectric element 5 mounted thereon.

Hereinafter, a piezoelectric speaker according to a third embodiment of the present invention will be described with reference to the drawings. FIG. 16 is a diagram illustrating a front surface of the piezoelectric speaker which does not have the piezoelectric element 5 mounted thereon. FIG. 17 is a cross-sectional view illustrating a structure of a section AA of the piezoelectric speaker shown in FIG. 16. FIG. 18 is a diagram illustrating the front surface of the piezoelectric speaker which have the piezoelectric element 5 mounted thereon. The front side and the back side of the piezoelectric speaker has the same structure, and therefore the structure of the front side (front surface) will be mainly described. In FIG. 17, an enlarged scale is used for a thickness direction so as to clearly illustrate structures of the frame 8, an external diaphragm 61, and an external frame 60, and a positional relationship thereamong.

A fundamental structure (a structure of the central portion) of the piezoelectric speaker shown in FIGS. 16 to 18 is based on the piezoelectric speaker described for the first embodiment. Specifically, the piezoelectric speaker according to the third embodiment additionally includes a diaphragm 61 provided around the periphery of the frame 8 of the piezoelectric speaker of the first embodiment and a frame 60 supporting the diaphragm 61 at the outer periphery thereof. Hereinafter, the frame 60 and the diaphragm 61 are referred to as an external frame 60 and an external diaphragm 61, respectively, as distinguished from other frames and diaphragms. Since the structure of the central portion inside the external frame 60 and the external diaphragm 61 is the same as that of the piezoelectric speaker described for the first embodiment, the same components are denoted by the same reference numerals and a detailed description thereof is not given.

For example, the external diaphragm 61 is formed by subjecting the laminated material 3 to the etching process so as to leave only the core layer 1 of the insulating material unremoved. In FIG. 16 and FIG. 18, portions in which the core layer 1 is exposed are indicated as diagonal line areas. Further, the external frame 60 supporting the external diaphragm 61 is formed by, for example, subjecting the laminated material 3 to the etching process so as to leave the skin layers 2 of the conductive material and the core layer 1 unremoved. That is, as indicated as the cross-sectional structure shown in FIG. 17, the aforementioned laminated material 3 of the flat plate is subjected to, for example, the etching process and/or the pressing process so as to integrally form the diaphragm 4, the frame 8, and the damper 9, which are provided on the central portion, and the external diaphragm 61 and the external frame 60.

A portion of the skin layers 2 of the external frame 60 is removed through the etching process and the like so as to form four removed portions, so that the external frame 60 is separated into four external frames 60*a*, 60*b*, 60*c*, and 60*d* which are insulated from each other. The four external frames 60*a*, 60*b*, 60*c*, and 60*d*, which are electrically insulated and separated from each other, are areas which are physically connected to each other through the core layer 1.

Further, on the external diaphragm 61, wiring sections 62*a*, 62*b*, 62*c*, and 62*d* connecting between the four frames 8*a*, 8*b*, 8*c*, and 8*d* and the external frames 60*a*, 60*b*, 60*c*, and 60*d*, respectively, are formed through the etching process or the like. In an example shown in FIG. 16 and FIG. 18, the wiring section 62*a* connects between the frame 8*a* and the external frame 60*a*. The wiring section 62*b* connects between the frame 8*b* and the external frame 60*b*. The wiring section 62*c* connects between the frame 8*c* and the external frame 60*c*. The wiring section 62*d* connects between the frame 8*d* and the external frame 60*d*.

The wiring sections 62*a*, 62*b*, 62*c*, and 62*d* may be formed by printing conductive pastes and the like on the external diaphragm 61. Further, in order to suppress split resonance occurring on the external diaphragm 61, the wiring sections 62*a*, 62*b*, 62*c*, and 62*d* may be formed at appropriate positions so as to reinforce the external diaphragm 61 or enhance a stiffness thereof. For example, the wiring sections 62*a*, 62*b*, 62*c*, and 62*d* of required widths may be provided at portions corresponding to nodes of resonance of the external diaphragm 61.

Further, the wiring sections 62*a*, 62*b*, 62*c*, and 62*d* may contain components such as coils, capacitors, and resistors, and other wiring patters may be further formed.

Next, as shown in FIG. 18, as in the aforementioned first embodiment, the piezoelectric elements 5L and 5R are adhered to the diaphragms 4L and 4R, respectively. The conductive paste 11L is provided as an electrical wiring so as to connect between the diaphragm 4L and the piezoelectric element 5L, and the conductive paste 11R is provided as an electrical wiring so as to connect between the diaphragm 4R and the piezoelectric element 5R.

Here, while a voltage applied to the diaphragm 4L through the external frame 60 and the wiring sections 62*a* and 62*b*, and a voltage applied to the diaphragm 4R through the external frame 60 and the wiring sections 62*c* and 62*d* are separate from each other as described above, a phase of the voltage applied to the diaphragm 4L is often approximate to or the same as a phase of the voltage applied to the diaphragm 4R at a low frequency reproduction. Accordingly, at the low frequency reproduction, the diaphragms 4L and 4R are displaced in phase with each other, and the external diaphragm 61 is also displaced in phase with the diaphragms 4L and 4R. Therefore, at the low-frequency reproduction, providing the external diaphragm 61 is advantageous to the low-frequency reproduction. Further, a diaphragm of an increased area is used to reproduce a sound, thereby enhancing a stereo effect at the reproduction.

Figure 19:
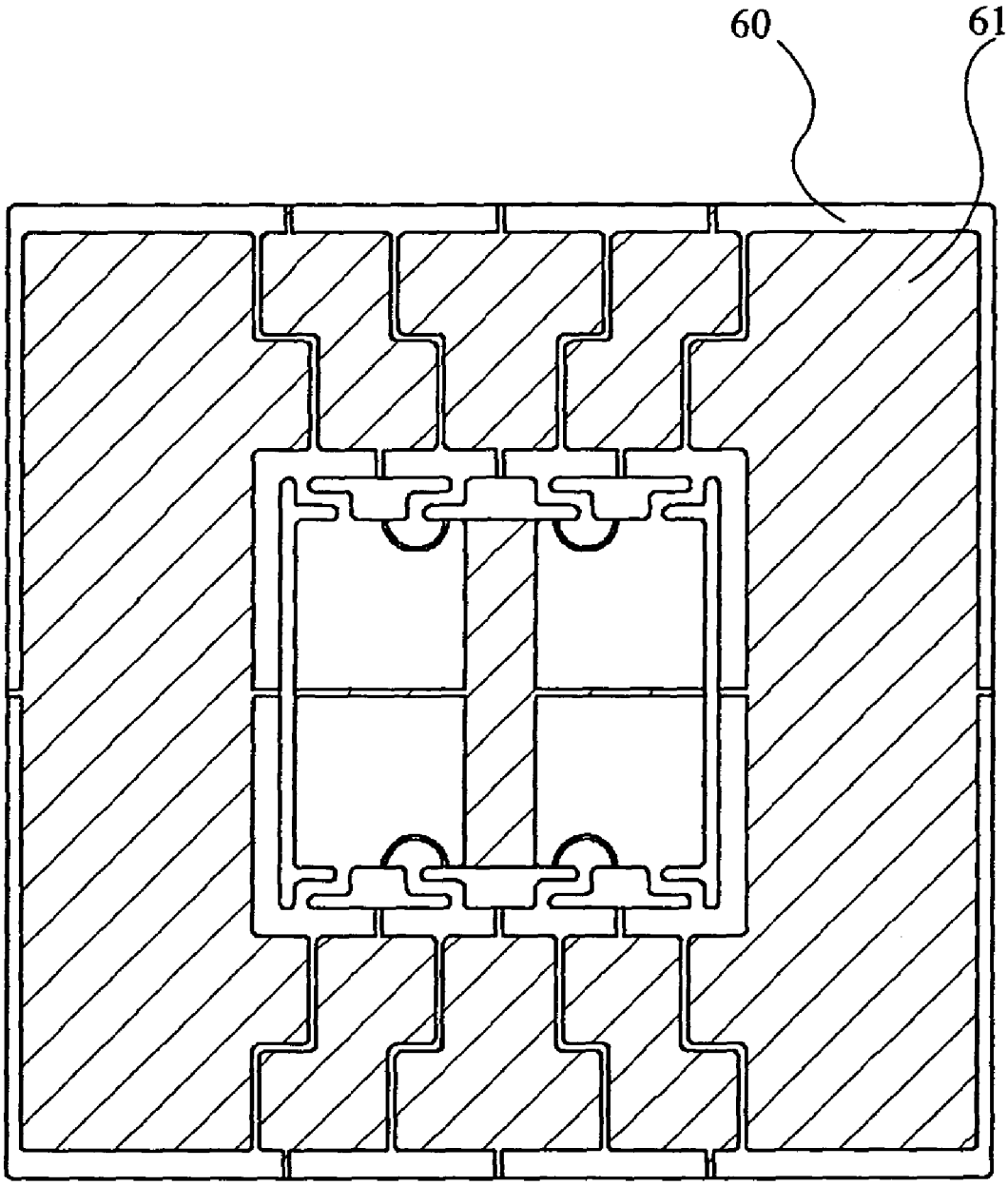
FIG. 19 shows an exemplary piezoelectric speaker in which an external diaphragm 61 is further provided around the periphery of a frame 28 according to the second embodiment, and an external frame 60 supporting the external diaphragm 61 at the outer periphery thereof is provided.

The piezoelectric speaker according to the present embodiment may be constructed based on the piezoelectric speaker described for the second embodiment. FIG. 19 shows an example where the external diaphragm 61 is further provided around the periphery of the frame 28 according to the second embodiment and the external frame 60 supporting the external diaphragm 61 at the outer periphery thereof is provided.

Moreover, the external diaphragm 61 may not be of the exposed core layer 1 formed by subjecting the laminated material 3 of the flat plate to the etching process. For example, as shown in FIGS. 20 to 22, two films 61U and 61D, which are resin films or the like, may be bonded to each other so as to form the external diaphragm 61 of a material other than the laminated material 3.

Figure 20:
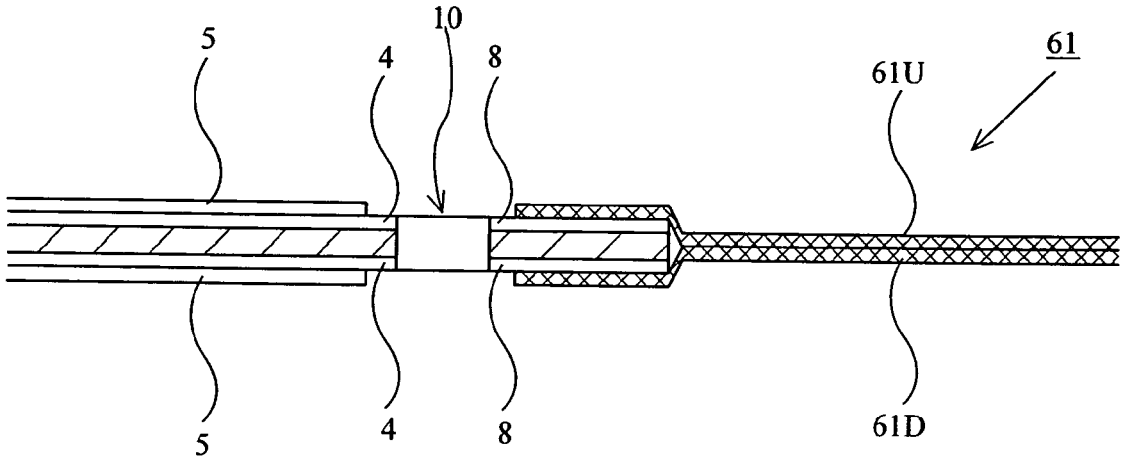
FIG. 20 is a diagram illustrating a first example where the skin layers 2 of the frame 8 of the piezoelectric speaker according to the first embodiment are sandwiched between two films 61U and 61D so as to be bonded thereto on one surface of one of the skin layers 2 and one surface of the other of the skin layers 2.

As a first example shown in FIG. 20, the skin layers 2 of the frame 8 of the piezoelectric speaker described for the first embodiment are sandwiched between the two films 61U and 61D so as to be bonded thereto on one surface of one of the skin layers 2 and one surface of the other of the skin layers 2, and the two films 61U and 61D are bonded to each other from the outer periphery of the frame 8 through the inner edge of the external frame 60 (not shown), thereby forming the external diaphragm 61.

Figure 21:
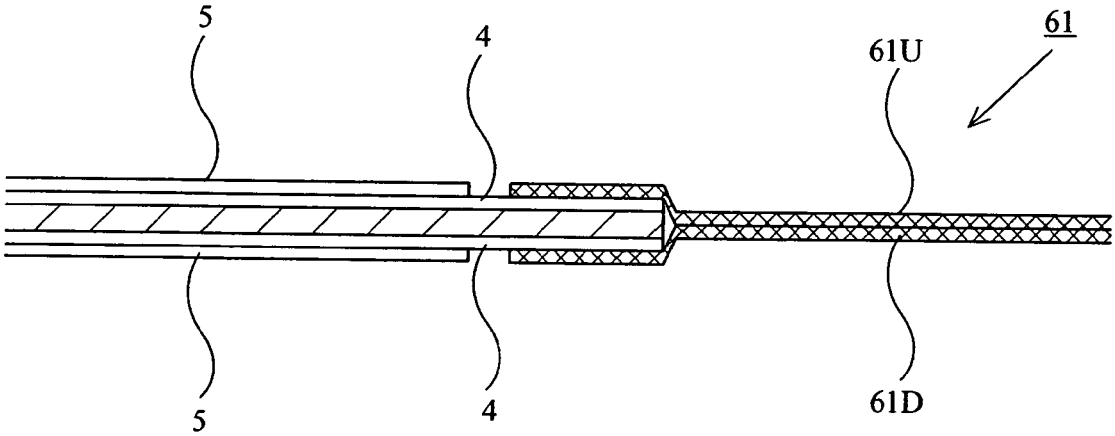
FIG. 21 is a diagram illustrating a second example where the skin layers 2 of each of the diaphragms 4L and 4R of the piezoelectric speaker according to the first embodiment are sandwiched between the two films 61U and 61D so as to be bonded thereto on one surface of one of the skin layers 2 and one surface of the other of the skin layers 2.

As a second example shown in FIG. 21, the skin layers 2 of each of the diaphragms 4L and 4R of the piezoelectric speaker described for the first embodiment are sandwiched between the two films 61U and 61D so as to be bonded thereto on one surface of one of the skin layers 2 and one surface of the other of the skin layers 2. The two films 61U and 61D are bonded to each other from the outer periphery of each of the diaphragms 4L and 4R through the inner edge of the external frame 60 (not shown), thereby forming the external diaphragm 61. In this case, each of the diaphragms 4L and 4R is directly sandwiched by and bonded to the external diaphragm 61, and therefore the frame 8, the edges 10, and the like can be eliminated.

Figure 22:
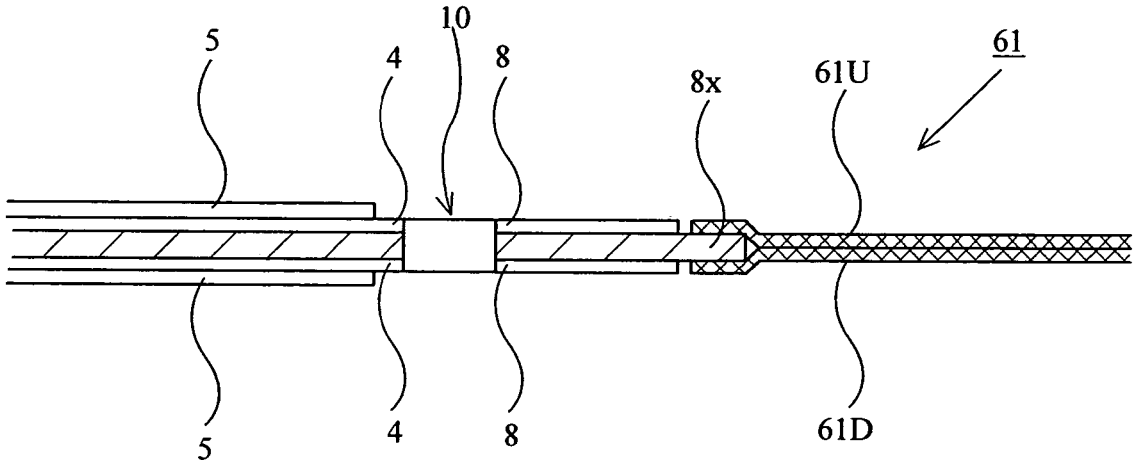
FIG. 22 is a diagram illustrating a third example where a core layer portion 8*x* of an arbitrary width is provided outward from the frame 8 around the entire periphery of the frame 8 of the piezoelectric speaker according to the first embodiment, and the core layer portion 8*x* is sandwiched between the two films 61U and 61D so as to be bonded thereto at both surfaces of the core layer portion 8*x*.

As a third example shown in FIG. 22, a core layer portion 8*x* of an arbitrary width is provided outward from the frame 8 around the entire periphery of the frame 8 of the piezoelectric speaker described for the first embodiment, and the core layer portion 8*x* is sandwiched between the two films 61U and 61D so as to be bonded thereto at both surfaces of the core layer portion 8*x*. The two films 61U and 61D are bonded to each other from the outer periphery of the core layer portion 8*x* through the inner edge of the external frame 60 (not shown), thereby forming the external diaphragm 61. As the core layer portion 8*x*, an external diaphragm of the aforementioned core layer 1 may be used.

When the two films 61U and 61D are bonded to each other so as to form the external diaphragm 61, the wiring sections 62*a*, 62*b*, 62*c*, and 62*d* may be provided between the two films 61U and 61D, or may be printed using the conductive pastes or the like after the two films 61U and 61D are bonded to each other. Further, in a case where an insulating film or the like is already provided in an area where the piezoelectric speaker is to be mounted, the film is allowed to function as the external diaphragm 61 when the piezoelectric speaker according to each of the first and the second embodiments is mounted on the film.

Figure 23:
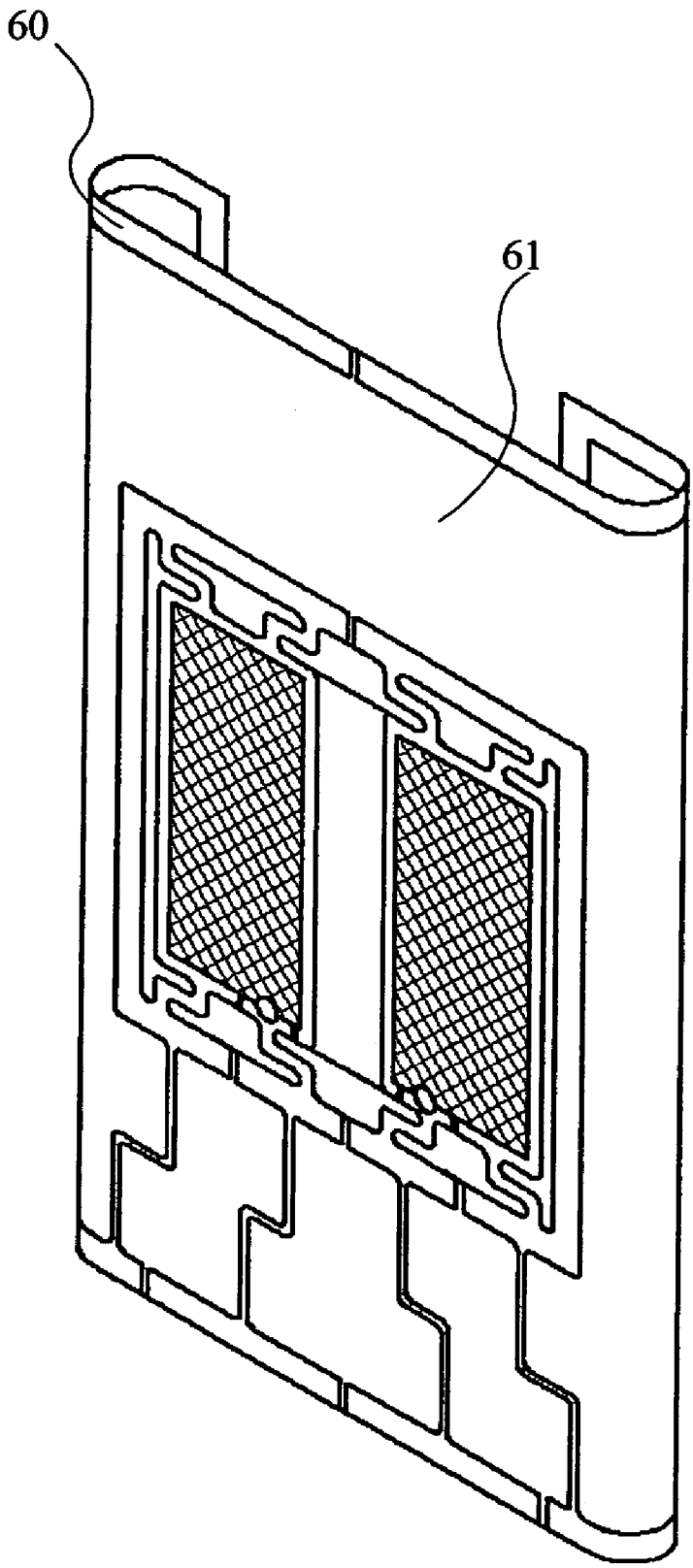
FIG. 23 is a diagram illustrating an example where the piezoelectric speaker, shown in FIG. 18, having a curved shape is to be mounted on a device.

Moreover, it is possible to mount, on a device, the piezoelectric speaker according to the third embodiment having a curved shape, as shown in FIG. 23, which can be formed by utilizing flexibility of the external diaphragm 61. When the piezoelectric speaker according to the present embodiment is mounted on a device such as a mobile telephone or a PDA, the core layer 1 or a film of insulating material provided on the outer periphery thereof functions as a diaphragm, whereby it is possible to form a piezoelectric speaker capable of improving the lower-frequency reproduction in a simplified manner. Therefore, the piezoelectric speaker, which can perform stereo reproduction and has preferable sound pressure characteristics at low-frequencies, can be mounted in a space of a reduced mounting volumetric capacity.

Figure 24:
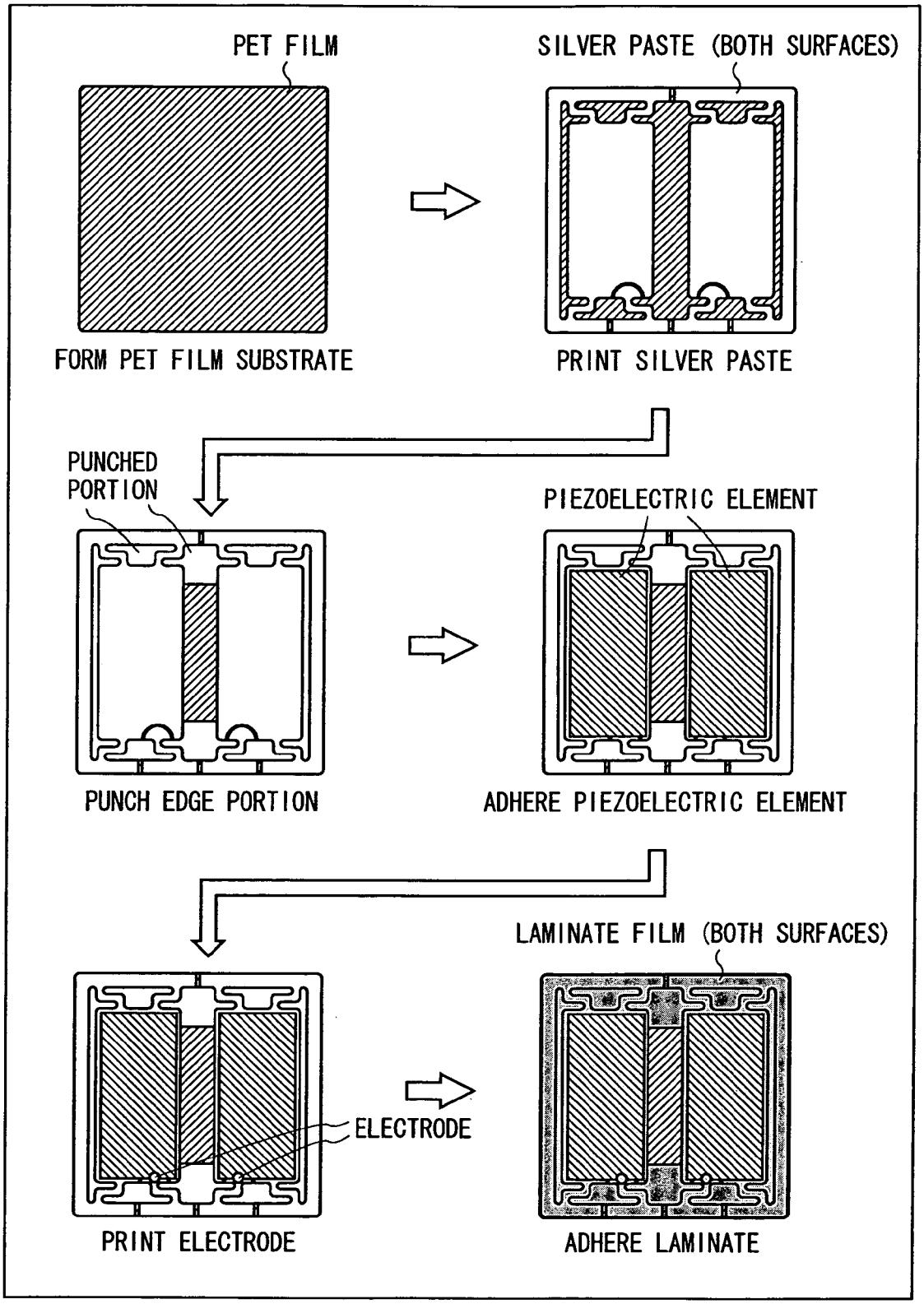
FIG. 24 is a diagram illustrating an exemplary process of manufacturing the piezoelectric speaker according to the embodiments of the present invention.
Figure 25:
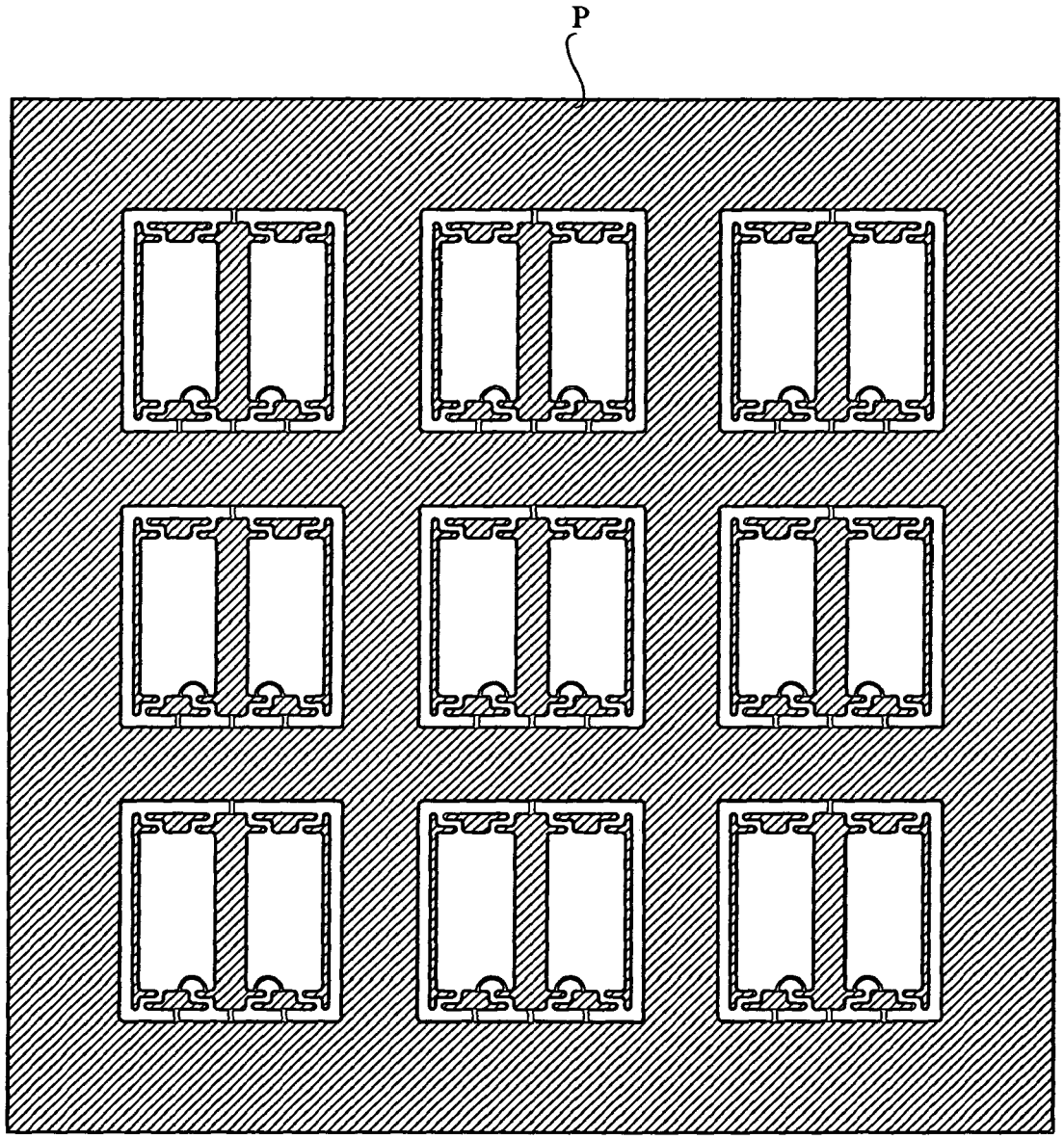
FIG. 25 is a diagram illustrating an example of a screen printing plate P used for printing silver paste.

Furthermore, although in the above description the laminated material 3 of the flat plate is subjected to the etching process so as to expose the core layer 1, thereby forming the diaphragm 4 and the like, the respective components may be formed using another technique. Hereinafter, with reference to FIGS. 24, 25, 26A, 26B, 26C, 26D, and 26E, a method for manufacturing the piezoelectric speaker according to the present invention using another technique will be described. FIG. 24 is a diagram illustrating an exemplary process of manufacturing the piezoelectric speaker according to the present embodiment of the present invention. FIG. 25 is a diagram illustrating an example of a screen printing plate P used for printing silver paste. FIGS. 26A, 26B, 26C, 26D, and 26E are schematic diagrams illustrating an exemplary process of printing the silver paste through a screen printing.

As shown in FIG. 24, initially, a PET (polyethylene terephthalate) film, which will form the core layer 1 of the laminated material 3 (see FIG. 1), is formed as a substrate having, for example, a thickness of 100 μm. In FIG. 24, an area of the PET film is indicated as a bottom-left to top-right rightward-rising-diagonal-line area, as distinguished from other materials.

Next, the silver paste is printed and baked on both surfaces of the PET film so as to form silver electrodes. The silver electrodes correspond to the skin layers 2 each of which integrally forms the diaphragm 4, the frame 8, and the damper 9 shown in FIG. 2. For example, as shown in FIG. 25, on a mesh screen having pores formed thereon, the pores on portions (that is, portions, indicated as rightward-rising-diagonal-line-areas in FIG. 25, on which no silver paste is to be printed) which require no printing are filled with resist agent or the like so as to form the plate P. As the screen, for example, a fabric screen made of silk, nylon, tetron, or the like, or a screen which is woven using stainless steel wire or the like is used. The screen is stretched from four corners of a predetermined frame so as to be stabilized, and pores on areas other than necessary areas are filled with plate films (resist) in an optical engineering (photographic) method so as to manufacture the screen printing plate P.

Figure 26A:
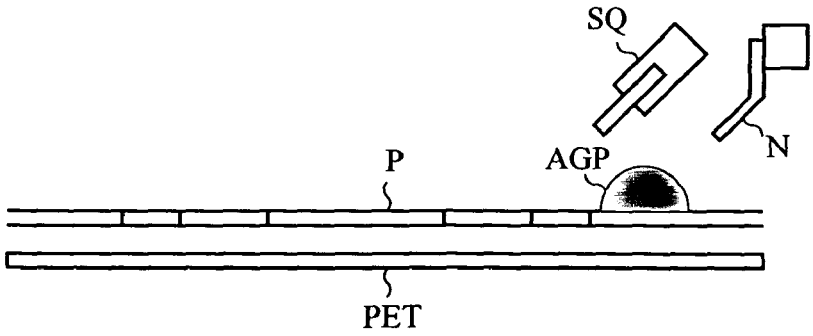
FIG. 26A is a schematic diagram illustrating an exemplary first step of a process of printing the silver paste through a screen printing.
Figure 26B:
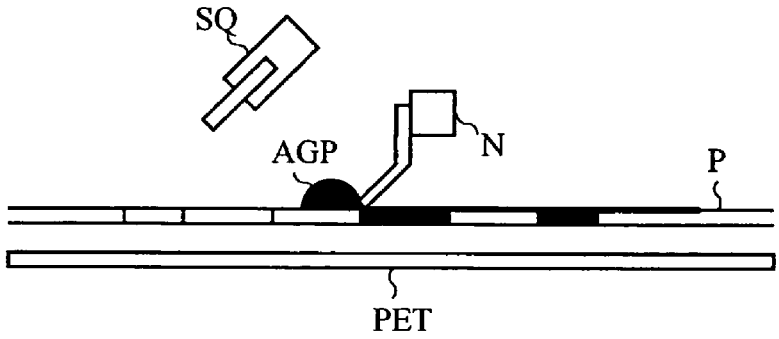
FIG. 26B is a schematic diagram illustrating an exemplary second step of the process of printing the silver paste through the screen printing.
Figure 26C:
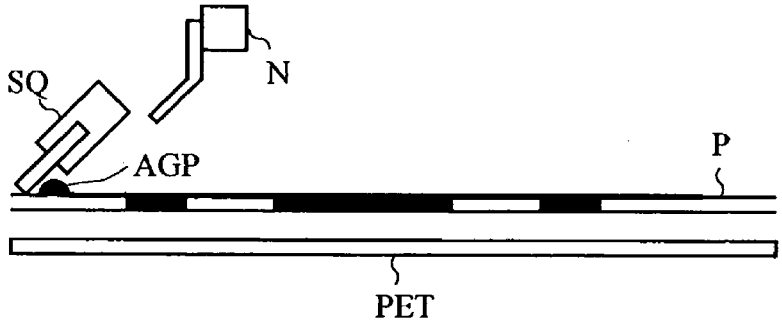
FIG. 26C is a schematic diagram illustrating an exemplary third step of the process of printing the silver paste through the screen printing.
Figure 26D:
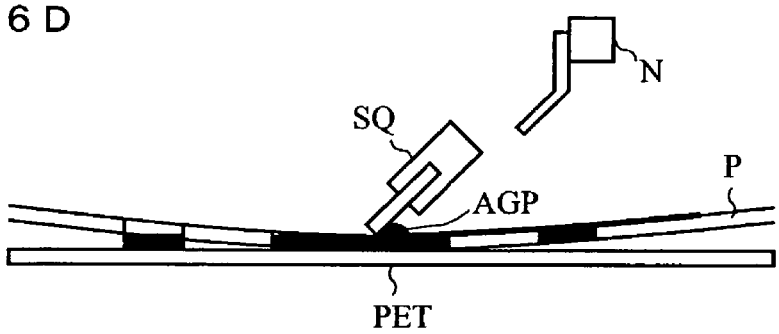
FIG. 26D is a schematic diagram illustrating an exemplary fourth step of the process of printing the silver paste through the screen printing.
Figure 26E:
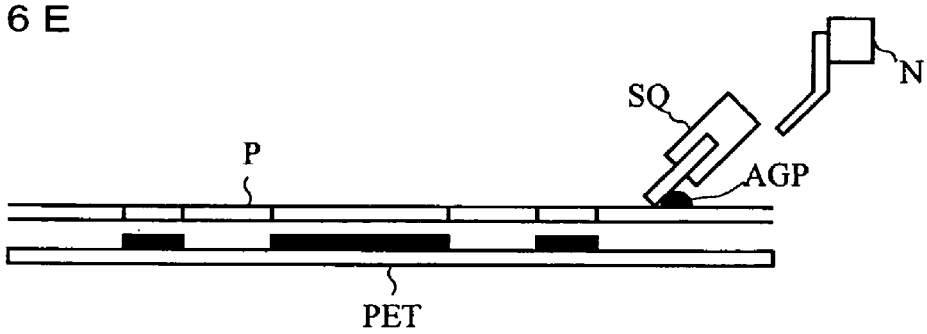
FIG. 26E is a schematic diagram illustrating an exemplary fifth step of the process of printing the silver paste through the screen printing.

As shown in FIGS. 26A, 26B, 26C, 26D, and 26E, the screen printing plate P is disposed on the PET film (shown as "PET" in FIG. 26) so as to print silver paste AGP. In printing, a spatular rubber plate (squeegee SQ) and a silver paste spreading knife N are used. The silver paste AGP is placed as an electrode on the screen printing plate P for providing a desired printing (FIG. 26A). Next, the silver paste AGP being spread flat with a tip portion of the silver paste spreading knife N for filling in the pores is moved on the screen printing plate P, thereby spreading the silver paste AGP over the screen printing plate P (FIG. 26B, FIG. 26C). The silver paste AGP is moved on the screen printing plate P with the top surface of the screen printing plate P being pressed by the squeegee SQ (FIG. 26D). Thus, the silver paste AGP is pressed onto the PET film placed under the screen printing plate P through the pores of the screen on the portions which are not filled with the plate film, thereby performing a printing on the PET film (FIG. 26E). Baking is performed under a predetermined condition (for example, 130° C., 15 minutes), thereby forming the silver electrode of a predetermined thickness (for example, 8 μm) on the PET film.

Returning to FIG. 24, after the silver paste is printed, the edges 10 (see FIG. 2) are formed by punching a portion of areas in which the PET film is exposed by using a punching die or a punch. Next, the piezoelectric elements are adhered to the front surfaces of the silver electrodes (diaphragm 4) using a predetermined adhesive (for example, acrylic adhesive). In FIG. 24, the piezoelectric elements are indicated as bottom-right to top-left leftward-rising-diagonal-line-areas, as distinguished from other materials. The electrode (conductive paste 11) is printed so as to electrically connect between the silver electrode (diaphragm 4) and the front surface of the piezoelectric element. The silver electrodes are formed on the PET film, and laminate films are adhered to both main surfaces of the piezoelectric speaker having the piezoelectric elements and the electrodes provided thereon. For example, as the laminate film, an SBR film having a film thickness of 90 μm is used and adhered thereto under a predetermined condition (100° C., 15 seconds). In FIG. 24, area having the laminate film adhered thereto is indicated as a gray area (that is, the entire surface), as distinguished from other materials.

The piezoelectric speaker and the method for manufacturing the same according to the present invention are useful as a speaker and the like which are mounted on a compact mobile device and the like, and are capable of performing stereo reproduction in a space having a reduced mounting volumetric capacity, and has an effect of providing preferable sound pressure characteristics at low frequencies.

The invention claimed is:

1. A piezoelectric speaker, comprising:

a plurality of diaphragms each formed by a laminated material in which a core layer made of an insulating material is laminated to layers each made of a conductive material so as to form skin layers on both surfaces of the core layer;

connecting components each corresponding to a plate-shaped component of an insulating material and each being connected between at least two of the plurality of diaphragms; and piezoelectric elements mounted on surfaces of the plurality of diaphragms, respectively, wherein the plurality of diaphragms are insulated from each other such that separate voltages are applied to the piezoelectric elements mounted thereon, respectively, and the connecting components are each formed by the core layer of the laminated material.

2. The piezoelectric speaker according to claim 1, wherein the piezoelectric speaker further comprises:

a frame; and first dampers and second dampers connecting between the frame and the plurality of diaphragms, and supporting the plurality of diaphragms such that the plurality of diaphragms are capable of linearly vibrating, wherein the plurality of diaphragms have insulating slits, respectively, each of which is formed between an area connected to the first dampers and an area connected to the second dampers by removing a portion of each of the skin layers, such that the first dampers are insulated from the second dampers on the plurality of diaphragms.

3. The piezoelectric speaker according to claim 2, wherein the plurality of diaphragms, the first dampers and the second dampers connected between the frame and the plurality of diaphragms, and the connecting components are disposed in the frame, and the plurality of diaphragms, the insulating slits, the first dampers, the second dampers, the connecting components, and the frame are integrally formed by processing each of the skin layers of the laminated material.

4. The piezoelectric speaker according to claim 3, wherein the plurality of diaphragms, the insulating slits, the first dampers, the second dampers, the connecting components, and the frame are formed on both surfaces of the laminated material by etching the skin layers of the laminated material on the both surfaces of the laminated material, using a predetermined pattern, at corresponding positions on a front side and a back side of the laminated material.

5. The piezoelectric speaker according to claim 2, wherein electrodes are formed on both surfaces of each of the piezoelectric elements, and one of the electrodes is formed on a surface of each of the piezoelectric elements on which each of the piezoelectric elements is mounted on one of the plurality of diaphragms, and contacts with the one of the plurality of diaphragms only in the area connected to the first dampers separated by the insulating slits.

6. The piezoelectric speaker according to claim 2, wherein the connecting components each connects between two of the plurality of diaphragms in a space therebetween, the two of the plurality of diaphragms corresponding to one of first diaphragms and one of second diaphragms which are disposed in line with each other, and the connecting components, the first diaphragms, the second diaphragms, the first dampers and the second dampers connecting the first diaphragms and the second diaphragms to the frame are disposed in the frame.

7. The piezoelectric speaker according to claim 6, wherein removal slits are provided, and each of the removal slits is formed between one of the first diaphragms and one of the second diaphragms by removing each of the skin layers in a direction perpendicular to a direction in which the one of the first diaphragms and the one of the second diaphragms are disposed in line with each other such that each of the removal slits allows two separated diaphragms to be formed.

8. The piezoelectric speaker according to claim 7, further comprising:

a signal input means for inputting an input signal of a left channel to the piezoelectric elements mounted on the first diaphragms and inputting an input signal of a right channel to the piezoelectric elements mounted on the second diaphragms when the piezoelectric speaker is oriented in a first direction in which each of the first diaphragms and each of the second diaphragms are disposed sideways in line with each other, and for inputting an input signal of the right channel to the piezoelectric elements mounted on one of the first diaphragms and one of the second diaphragms which are separated by a corresponding one of the removal slits, and inputting an input signal of the left channel to the piezoelectric elements mounted on another of the first diaphragms and another of the second diaphragms which are separated by a corresponding one of the removal slits when the piezoelectric speaker is oriented in a second direction in which each of the first diaphragms and each of the second diaphragms are disposed lengthwise in line with each other.

9. The piezoelectric speaker according to claim 1, wherein the conductive material of the skin layers is a metal thin film material containing at least one selected from the group consisting of a 42 alloy, a stainless steel, a copper, an aluminum, a titanium, and a silver paste, and the insulating material of the core layer is at least one selected from the group consisting of a polyimide and polyimide metamorphic body.

10. The piezoelectric speaker according to claim 1, wherein the conductive material of the skin layers is a metal thin film material containing at least one selected from the group consisting of a 42 alloy, a stainless steel, a copper, an aluminum, a titanium, and a silver paste, and the insulating material of the core layer is a rubber high polymer containing at least one selected from the group consisting of an SBR, an NBR, and an acrylonitrile.

11. The piezoelectric speaker according to claim 1, wherein the conductive material of the skin layers is a metal thin film material containing at least one selected from the group consisting of a 42 alloy, a stainless steel, a copper, an aluminum, a titanium, and a silver paste, and the insulating material of the core layer is a plastic material containing at least one selected from the group consisting of polyethylene terephthalate, polycarbonate, and polyallylate film.

12. The piezoelectric speaker according to claim 1, further comprising:

an external diaphragm, connecting to the plurality of diaphragms, formed by a film component of an insulating material and provided in an outer periphery area of the plurality of diaphragms.

13. The piezoelectric speaker according to claim 12, wherein the external diaphragm and the plurality of diaphragms are integrally formed by extending the core layer of the laminated material of the plurality of diaphragms.

14. The piezoelectric speaker according to claim 2, further comprising:

an external diaphragm, connecting to the frame, formed by a film component of an insulating material and provided in an outer periphery area of the frame.

15. The piezoelectric speaker according to claim 14, wherein the external diaphragm and the plurality of diaphragms are integrally formed by extending the core layer of the laminated material of the plurality of diaphragms.

* * * * *